US005240072A

United States Patent [19]

Schultz et al.

[11] Patent Number: 5,240,072

[45] Date of Patent: Aug. 31, 1993

[54] MULTIPLE SAMPLE ANNULUS PRESSURE RESPONSIVE SAMPLER

[75] Inventors: Roger L. Schultz, Richardson; Harold K. Beck, Copper Canyon, both of Tex.

[73] Assignee: Halliburton Company, Duncan, Okla.

[21] Appl. No.: 765,075

[22] Filed: Sep. 24, 1991

[51] Int. Cl.[5] ..... E21B 49/08

[52] U.S. Cl. ..... 166/169; 166/264; 166/325

[58] Field of Search ..... 166/264, 66.4, 319, 166/325, 240, 162, 169; 73/564.63

[56] References Cited

U.S. PATENT DOCUMENTS 4,583,595 4/1986 Czernichow et al. ..... 166/264
4,665,983 5/1987 Ringgenberg ..... 166/264 X
4,721,157 1/1988 Berzin ..... 166/169
4,856,585 8/1989 White et al. ..... 166/264 X
4,903,765 2/1990 Zunkel ..... 166/162

*Primary Examiner*—William P. Neuder
*Attorney, Agent, or Firm*—Jennifer R. Daunis; C. Dean Domingue

[57] ABSTRACT

The invention discloses a multiple sample annulus pressure responsive sampler which allows the collection of samples at different time intervals and at different depth intervals in a wellbore. In one embodiment, the tool contains cylindrical housing means, a power piston, means for biasing the power piston, an oil case, an air case, valve means, valve activation means, and means for sampling the well fluid. In a second embodiment, the valve activating means includes energizing means for energizing an electric motor. In a third embodiment, a rupture disc is used in order to axially move the power piston.

26 Claims, 13 Drawing Sheets

MULTIPLE SAMPLE ANNULUS PRESSURE RESPONSIVE SAMPLER

BACKGROUND OF THE INVENTION

This invention relates to downhole tools used to collect samples in a wellbore. More particularly, but not by way of limitation, this invention relates to an apparatus and method of collecting multiple samples of fluid from an oil and gas reservoir that has been penetrated by a wellbore.

Various types of samplers have been used in the past. For instance, in U.S. Pat. No. 4,903,765 to Zunkel, there is disclosed a delayed opening fluid sampler containing multiple sample chambers. The sampler is lowered into the wellbore on a workstring to the desired depth. According to the techniques taught by Zunkel, in order to begin operation, a sufficient amount of annulus pressure must be applied to shear a set of holding pins. A fluid restriction was provided so that a time delay is established between the period from applying annulus pressure and the collecting of the sample.

Another type of fluid sampler is found in U.S. Pat. No. 4,665,983 to Ringgenberg. Again, this type of sampler is lowered into the wellbore to the desired depth, a port defined in the tool is opened in response to annulus pressure whereby the port admits well fluid into a sample chamber.

Also, applicant has submitted application Ser. No. 602,840, entitled "Wellbore Fluid Sampler" on Oct. 24, 1990, and application Ser. No. 602,823 on Oct. 24, 1990. These applications deal with samplers, and more particularly, to means of activating samplers. See also application Ser. No. 730,211 filed on Jul. 15, 1991 which pertains to a Shut-In Tool With Electric Timer.

The assignee of the present invention has also developed an annulus pressure responsive tool which operates in response to a relatively low annulus pressure increase as shown in U.S. Pat. Nos. 4,422,506 and 4,429,748, both to Beck and assigned to the assignee of the present invention.

These low pressure responsive tools shown in U.S. Pat. Nos. 4,422,506 and 4,429,748 have a power piston which is exposed to well annulus pressure from above, and which has its lower surface exposed to pressurized nitrogen gas in a nitrogen chamber located there below. Located below the nitrogen chamber is a metering chamber or equalizing chamber which is filled with oil. A floating piston separates the gas in the gas chamber from the oil in the metering chamber. Disposed in the metering chamber is a metering cartridge which provides a resistance to flow of oil therethrough. The lower end of the metering chamber below the metering cartridge is communicated with well annulus pressure, and a second floating piston separates the oil in the metering chamber from well fluid which enters the lower end of the metering chamber. An increase in well annulus pressure is immediately communicated to the upper surface of the power piston, but is delayed for a significant period of time in being fully communicated to the lower side of the power piston, so that a rapid increase in well annulus pressure will cause a downward pressure differential across the power piston to move the power piston and actuate the tool.

In U.S. Pat. No. 4,667,743 to Ringgenberg and Beck, the patent discloses an annulus, low pressure responsive flow tester valve having a lug and slot ratchet means operably connecting the ball valve of the tool with power piston.

In oil and gas operations, the operator often finds it desirable to retrieve multiple fluid samples taken at different time intervals. Moreover, the operator may wish to take multiple samples at different depth intervals in the wellbore. Prior art samplers simply have not been able to obtain multiple samples at different times and different intervals; therefore, there is a need in the industry for a sampler that can obtain multiple samples.

SUMMARY OF THE INVENTION

The present invention includes both apparatus and method claims to an annulus pressure responsive sampler. The apparatus includes a cylindrical housing assembly which contains a plurality of tubing ports, and means for selectively opening the tubing ports. An atmospheric chamber case and oil chamber case is also included which is located within the cylindrical housing assembly. Also, valve means, located between the atmospheric chamber case and the oil chamber case, is included for controlling the flow of oil to the air chamber case.

The apparatus further includes valve activating means, operably associated with the tubing hydrostatic ports, for supplying working pressure to the valve means so that the valve means can be opened. A means for sampling a portion of the fluid in the workstring, which is responsive to the valve means, is also included.

The valve means for selectively exposing the tubing ports includes a first power piston, responsive to changes in annulus pressure as communicated through the first annulus port, which is slidably disposed within the cylindrical housing. Operably associated with the power piston is means for biasing the power piston so that as annulus pressure is released, the power piston returns to its initial position.

The valve means comprises a first stem containing a passageway bored therethrough and a transverse port intersecting the passageway. Attached to the stem is a cylindrical body assembly containing a passageway and impedance means for impeding the flow of fluid in the passageway. Also included is a second stem having a cavity with a transverse port so that the first stem and second stem are operatively associated and wherein the second stem is slidably disposed within the passageway that communicates with the tubing internal diameter so that the second stem is responsive to hydrostatic pressure changes within the passageway.

The valve actuating means contains an operating mandrel slidably disposed within the cylindrical housing and sealingly isolating the tubing port, and a passageway leading from the tubing port. Ratchet means are also provided on the operating mandrel and power piston for selective longitudinal movement with the power piston so that as the power piston moves down, the operating mandrel will also move down, but as the power piston is biased back up, the operating mandrel remains stationary.

A second embodiment discloses a valve activating means which is controlled by electronic means. The valve activation means comprises: an annular pressure sensing means for sensing the annulus pressure; an electric motor with an operably associated threaded shaft; energizing means which may be a microprocessor; mechanical activation means for exposing a tubing port to tubing hydrostatic pressure; and battery supply means for supplying electric power to the energizing means and the motor.

A third embodiment discloses a sampling apparatus which includes means for axially urging the power piston longitudinally downward, which includes a rupture disc located in an annulus port blocking the annular hydrostatic pressure. The disc is selected at a predetermined burst setting. Also, an atmospheric chamber case is included with the power piston positioned therein. Thus, once the rupture disc has burst, the annular hydrostatic pressure acts against the power piston, which has atmospheric pressure on one side, allowing the piston to move axially downward.

A method of sampling a formation fluid in the internal diameter of a workstring is also disclosed. Generally, the method includes the steps of increasing the annular pressure, forcing the power piston to move longitudinally downward, and exposing the first tubing port to the tubing hydrostatic pressure. Next, a first valve is opened so that fluid can communicate between the oil chamber and the air chamber. The flow is impeded so that a time lapse occurs. As fluid is flowing from the oil chamber to the air chamber, a sample of fluid is being taken.

Next, the annular pressure is decreased in the wellbore. The power piston is biased longitudally downward, and the operating mandrel is retained from upward movement. The workstring may then be positioned at a different location in the wellbore, or the operator can wait a predetermined length of time.

Subsequently, the annular pressure is again increased, forcing the power piston longitudinally downward within the cylindrical housing, and exposing the second tubing port to tubing hydrostatic pressure. This port leads to a second passageway which connects with a second valve so that the second valve can be opened allowing fluid communication between another set of oil and air chambers. The fluid flow is impeded, and as oil flows out of the chamber, a sample is taken. These steps can be repeated for each sample apparatus that has been placed about the periphery of the tool.

A feature of the present invention includes having biasing means for biasing the power piston to return to its initial position. Another feature includes the ratchet means for selectively moving the operating mandrel downward, without also causing the operating mandrel to move in an upward position. Still another feature includes the plurality of tubing ports which allow for selective activation of the various samplers positioned about the periphery of the tool.

Yet another feature of the tool includes the novel valve means, with the valve stem being activated by the tubing hydrostatic pressure. Another feature includes having a retaining means for restricting movement of the operating mandrel. Still another feature includes an impedance means which allows for a time delay.

Another feature includes the use of electronic means in order to activate the valve means. In one embodiment, a microprocessor is pre-programmed to interpret annular pressure increases in order to energize an electronic motor.

An advantage of the invention allows for selectively exposing the tubing ports at a time and location determined by the operator. Another advantage is the repositioning of the power piston to its original position by the release of annular hydrostatic pressure. Still another advantage is the placement of multiple samplers in the downhole workstring.

Another advantage includes having annular hydrostatic pressure control operation of the mandrel and having tubing pressure control the valve actuation means. Yet another advantage includes the use of a rupture disc which can be selected at a desired burst strength before the tool is run into the wellbore. Still another advantage includes use of electronic means which allows activation of the valve means based on pressure signals in the wellbore annulus.

DETAILED DESCRIPTION OF THE PREFERRED EMBODIMENT

Figure 1:
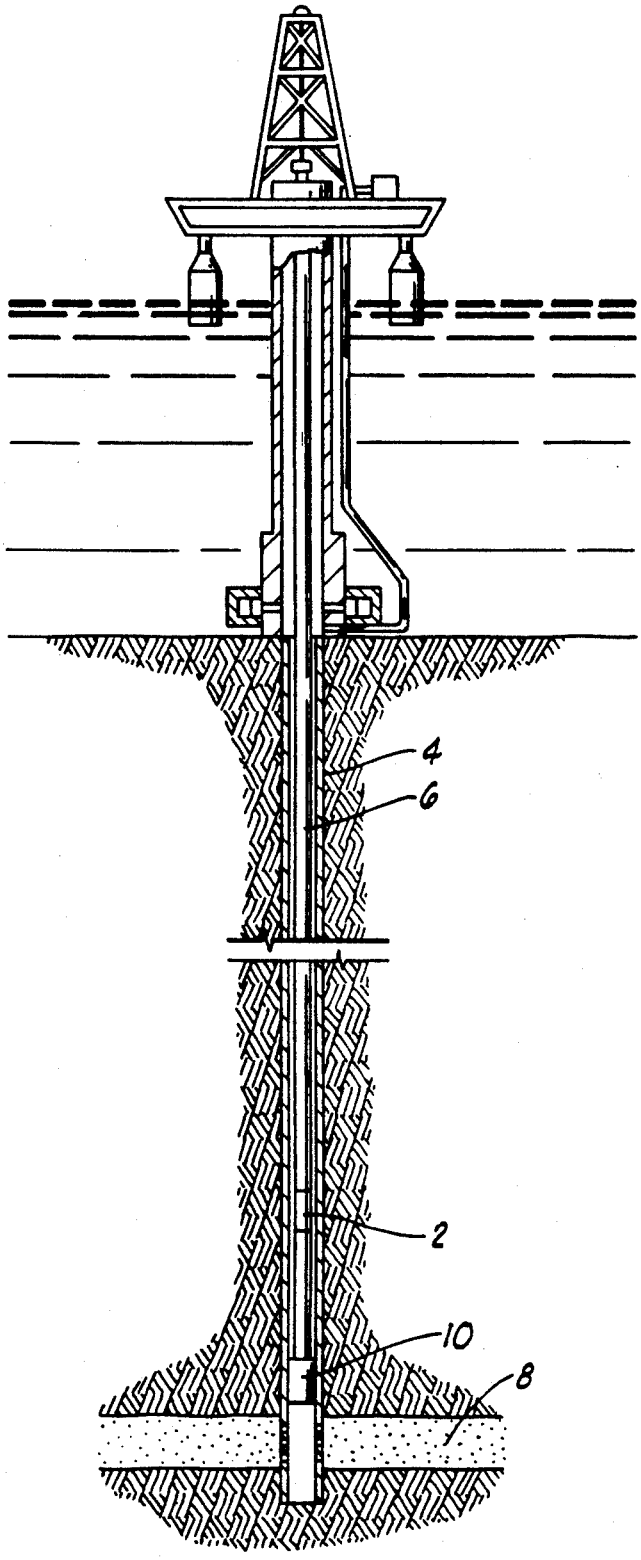
FIG. 1 is diagram depicting an environment in which the preferred embodiment of the present invention is particularly adapted for use.

Referring to FIG. 1, the downhole sampler 2 is lowered into the wellbore 4 by means of a workstring 6. The wellbore penetrates an oil and gas reservoir 8, and as will be appreciated by those skilled in the art, the well may penetrate several zones (not shown). Packer means 10, to isolate the reservoir, will be employed.

The operator may wish to obtain a sample from the oil and gas reservoir, then flow the well for a period of time, then obtain a second sample. Alternatively, the operator may wish to position the sampler at a second location in order to sample a second reservoir.

Figure 2A:
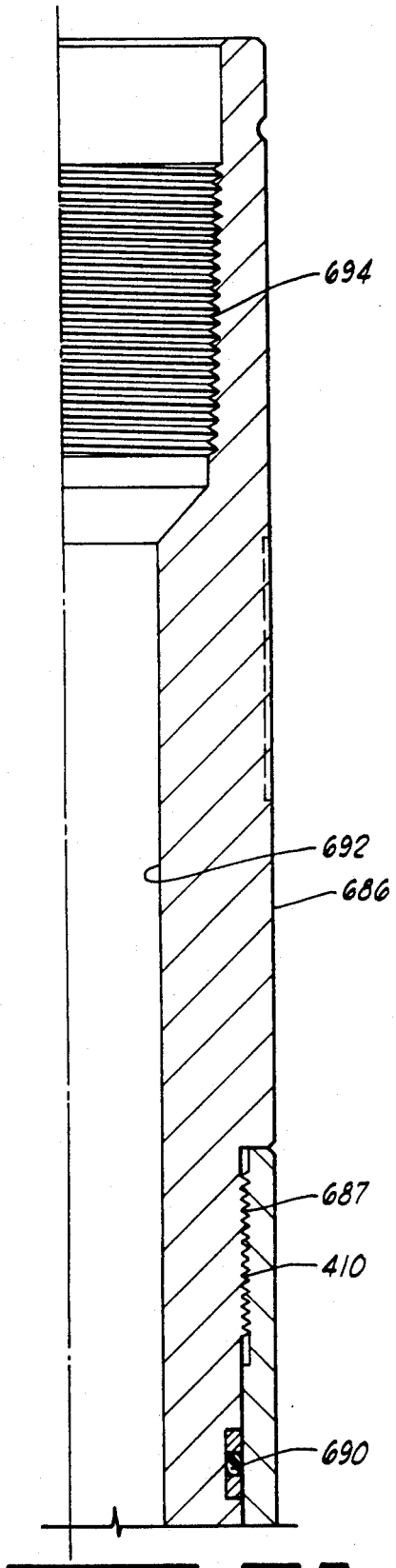
FIGS. 2A–2K form a longitudinal sectional view of a preferred embodiment to the present invention, wherein annular pressure has been applied.
Figure 2B:
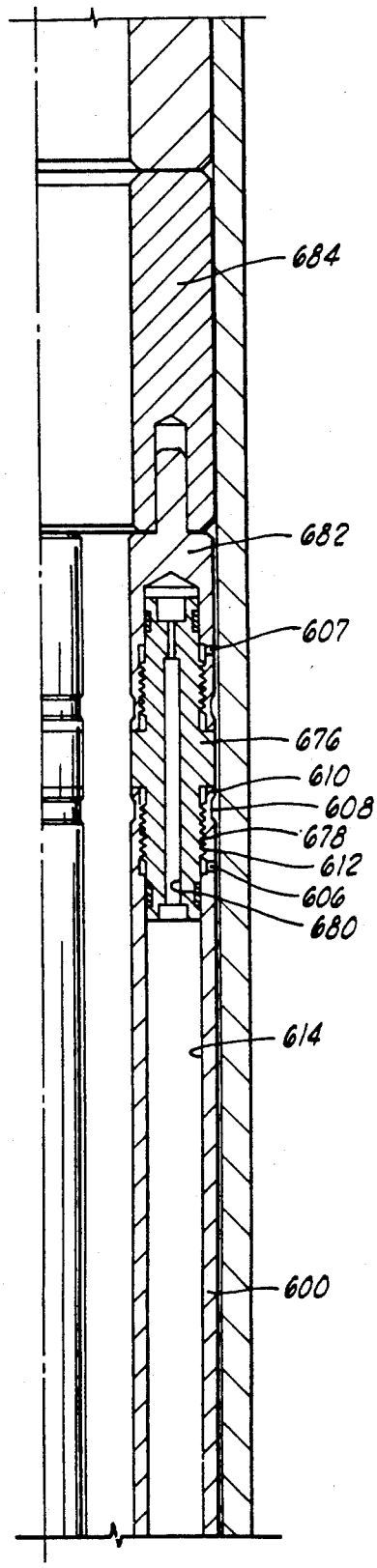
Figure 2C:
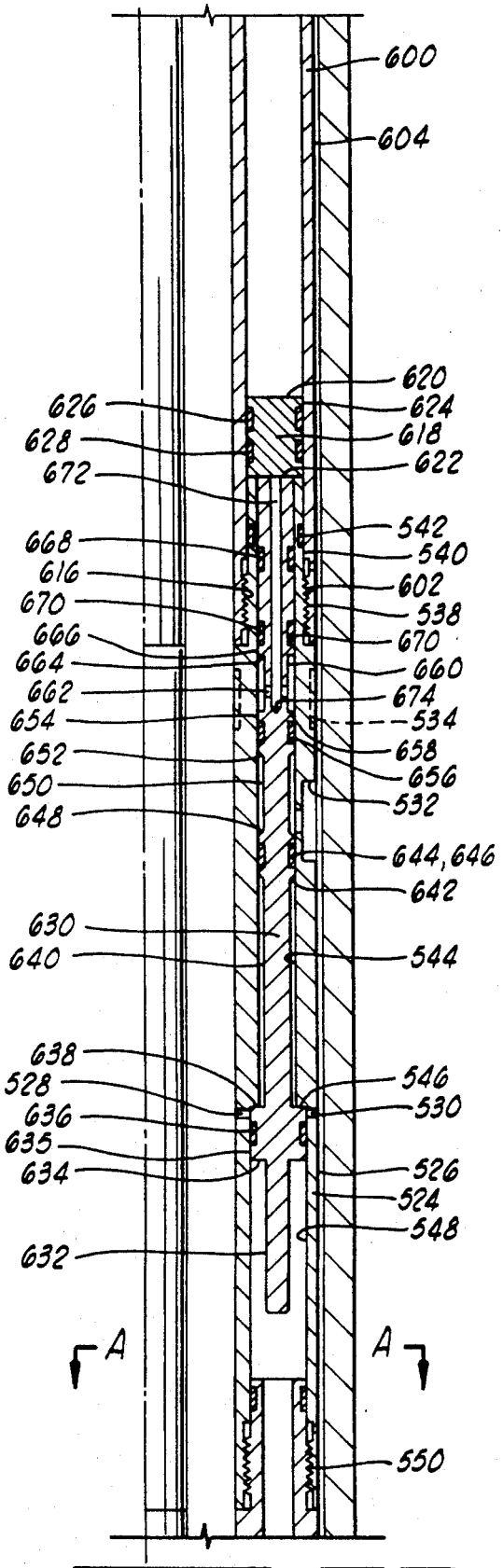
Figure 2D:
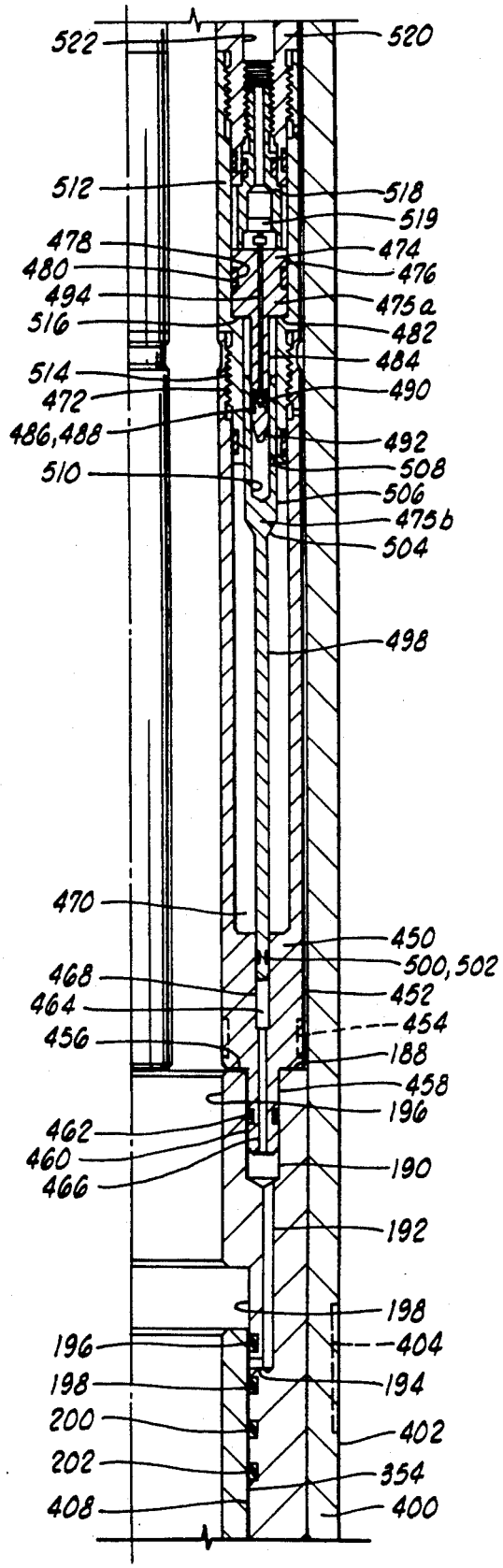
Figure 2E:
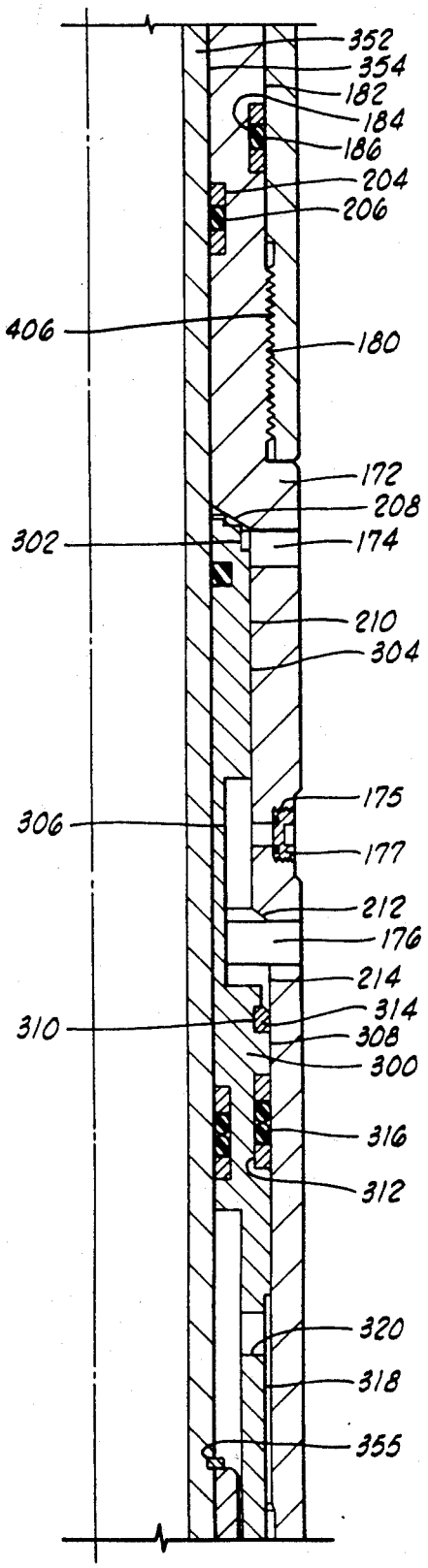
Figure 2F:
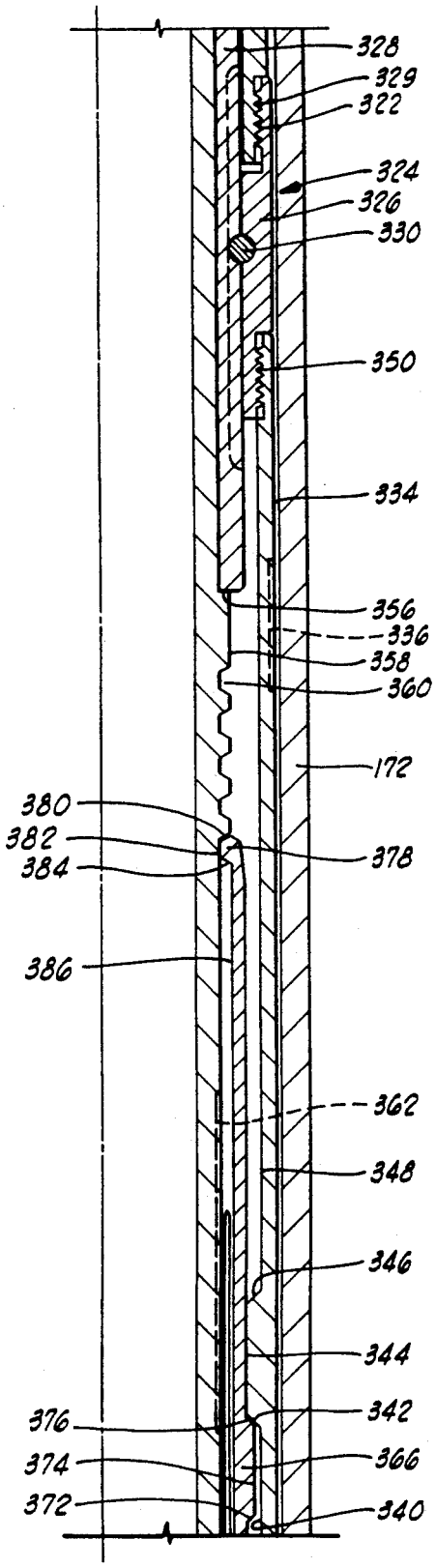
Figure 2G:
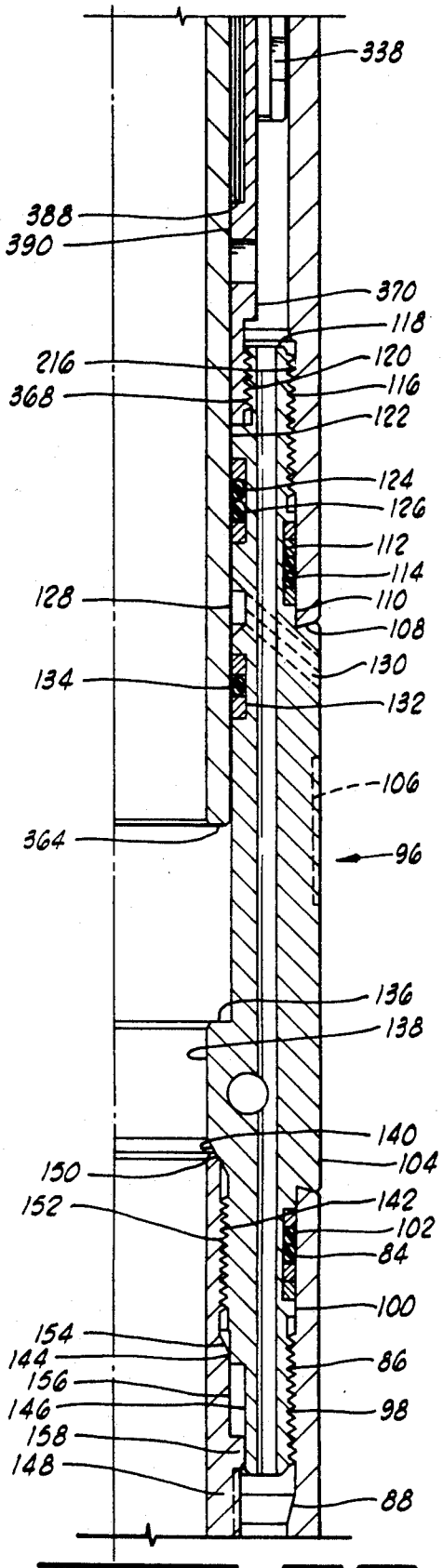
Figure 2H:
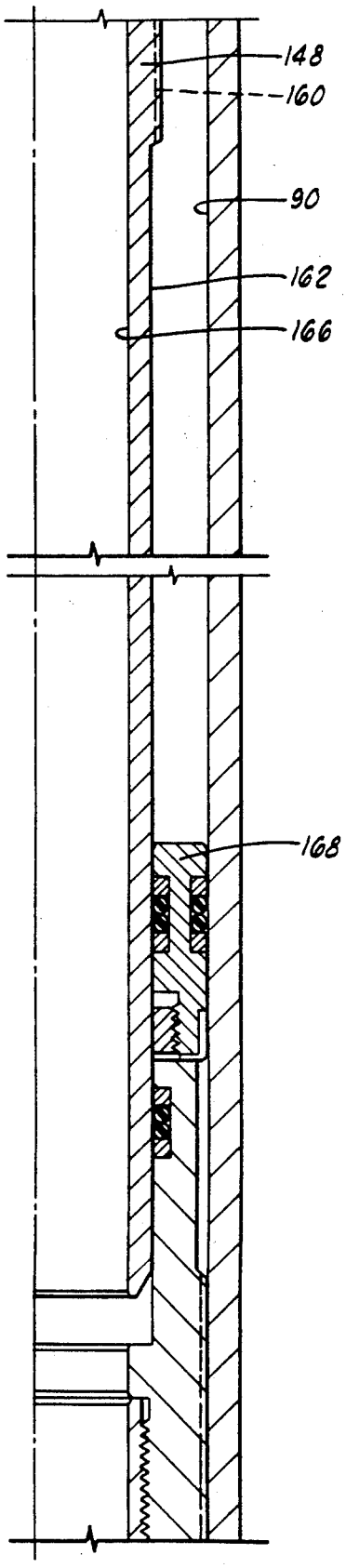
Figure 2I:
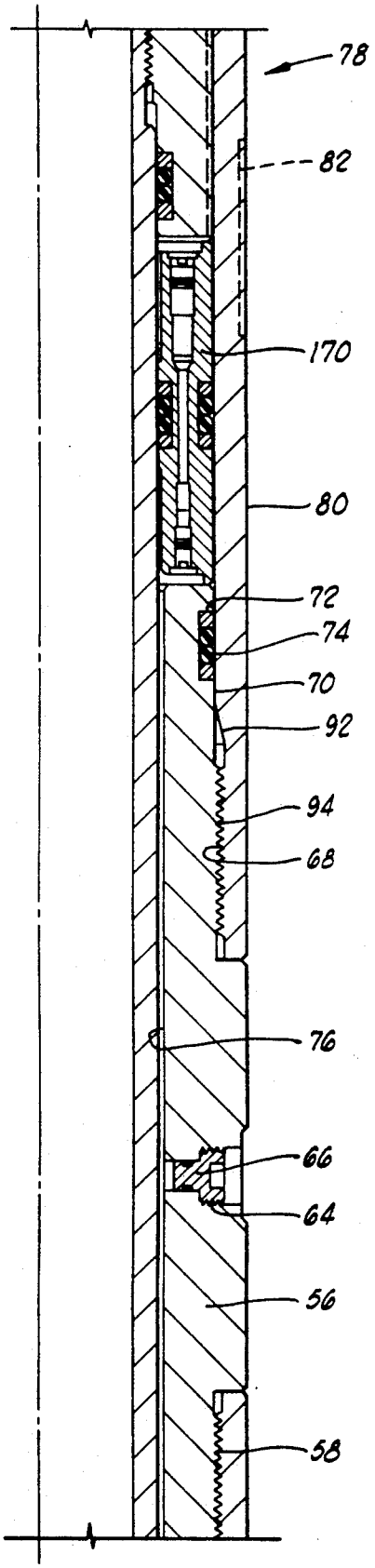
Figure 2J:
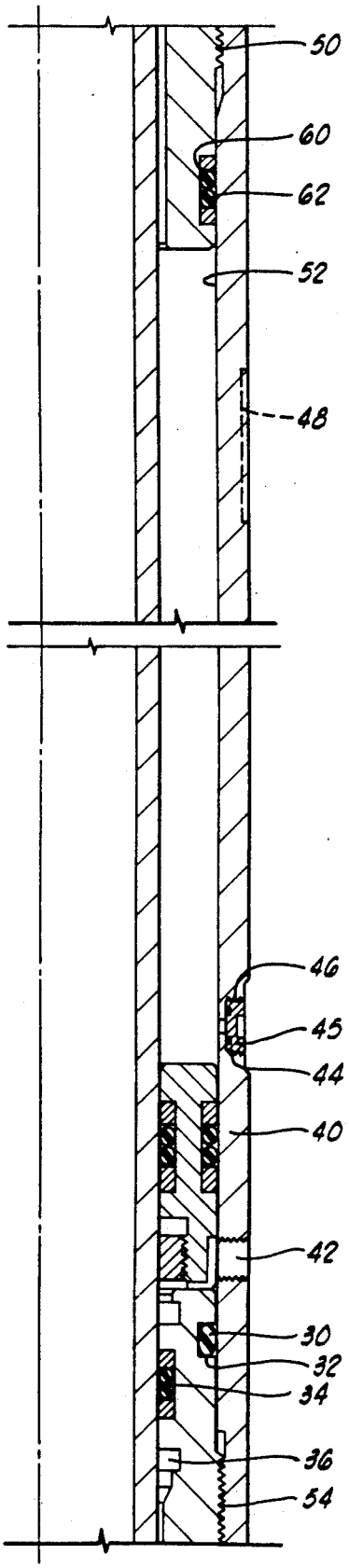
Figure 2K:
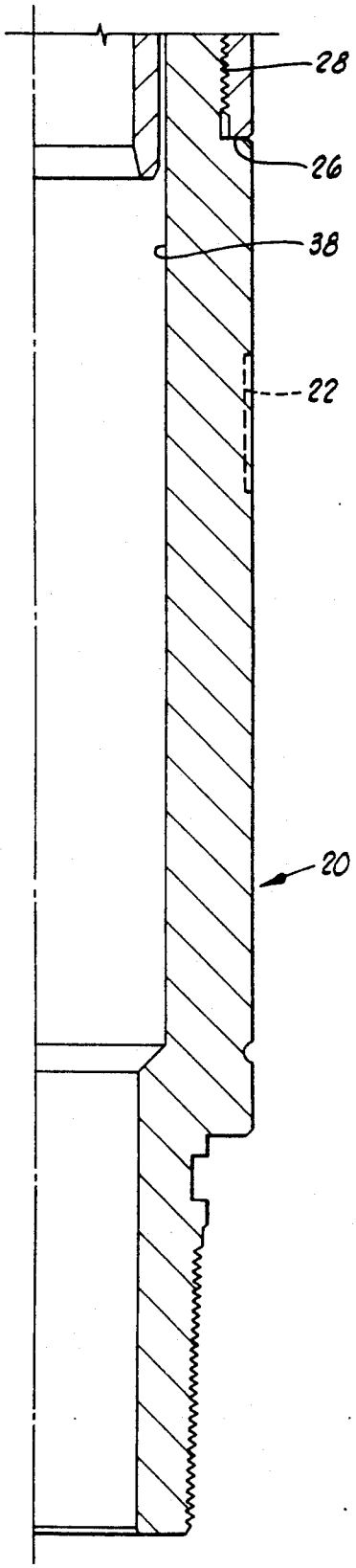

Referring of FIG. 2K, the invention generally comprises a lower sub 20 which contains on the outer diameter wrenching flats 22. Extending therefrom is cylindrically flat surface 24, which has in turn radially flat shoulder 26, and extending therefrom is external thread means 28 with elastomeric seal means 30 seated in recessed groove 32.

With reference to FIG. 2J, extending radially inward, the lower sub 20 contains a first and second groove, respectively 34 and 36, with internal diameter bore 38 leading therefrom.

Oil chamber case 40, on the outer diameter, has a first annulus port 42 bored therethrough, as well as oil fill port 44 which has placed therein a suitable plug 45 with thread means 46 for containing the oil placed in case 40. Also contained on the oil chamber case 40 is wrenching flats 48. Extending radially inward, the invention includes internal thread means 50, having in turn internal bore 52, which extends to the second internal thread means 54.

Referring to FIG. 2I, spacer sub 56 is threadedly attached to the oil chamber case 40 by means of external thread means 58, which has extending therefrom a recessed groove 60 for placement of an elastomeric seal means 62. The spacer sub 56 has, on the external portion thereof, an oil fill port 64 with accompanying plug 66. The spacer sub 56 terminates with external thread means 68, which has in turn, sealing bore 70 with groove 72 for placement of elastomeric seal member 74. Extending radially inward is internal bore 76.

Nitrogen chamber case 78 has a generally cylindrical outer surface 80 which has in turn winching flats 82. With reference to FIG. 2G, extending radially inward is sealing bore 84 which has in turn internal thread means 86. Chambered shoulder 88 has extending therefrom internal bore 90 which terminates at second chambered shoulder 92 and internal thread means 94.

Nitrogen chamber case top sub, seen generally at 96 on FIG. 2G, comprises on the outer diameter, an external thread means 98 which has in turn a sealing bore 100 with elastomeric seal members 102 placed therein. Extending therefrom is outer cylindrical surface 104 containing wrenching flats 106 terminating at angled shouldered 108 which has extending therefrom sealing bore 110 and recess 112, with elastomeric members 114 contained therein. External thread means 116 terminate at radially flat surface 118.

Extending radially inward from surface 118 is internal thread means 120 which terminates at internal sealing bore 122, with sealing bore 122 containing recess 124 with elastomeric seal members 126 positioned therein.

Sealing bore 122 further comprises: an exit port 128 which forms the exit of passageway 130; a second recess 132 which contains elastomeric member 134; and, radially flat shoulder 136. The internal diameter of the nitrogen chamber case 96 also contains a second surface 138 which has in turn chambered surface 140 and internal thread means 142, third surface and fourth surface 146.

An internal mandrel 148 comprises on the outer periphery a first chambered surface 150, external thread means 152, second chambered surface 154, cylindrical surface 156, radially extending shoulder 158, (external thread means 160), and having in turn first cylindrical bore 162.

Extending radially inward from the first cylindrical surface 162 is internal bore 166.

The nitrogen chamber case 78 and internal mandrel 148 form the nitrogen chamber case for holding pressured nitrogen. The nitrogen piston 168 is slidably disposed within case 78. Turning to FIG. 2I, means for impeding the oil, which is enclosed in the bottom chamber case 40, is provided generally at 170. The impeding means which may be used is the Lee Visco Jet disclosed in U.S. Pat. 3,323,550; the disclosure is incorporated by express reference thereto.

The outer cylindrical housing 172, seen in FIG. 2E, comprises on the outer diameter a first annulus port 174 and a second port 176, with a radially inward extending shoulder 178. Oil fill port 175 and the receptacle plug 177 are also contained thereon. The outer cylindrical housing 172 also contains external thread means 180 and sealing bore 182, with sealing bore 182 containing recess 184 and elastomeric seal member 186.

Turning to FIG. 2D, radially flat shoulder 188 has bored therethrough tubing passageway 190 of first diameter and passageway 192 of second diameter, which is transversed by a third passageway 194 which is communicated with the internal diameter of the outer cylindrical housing 172.

The outer cylindrical housing 172 has, on the internal diameter, a first surface 196 and second surface 198 which has in turn a plurality ports such as port 194 which have been defined on the internal diameter, and a plurality of elastomeric seal means 196, 198, 200 and 202 which surround the plurality of ports. A recessed groove 204 which contains elastomeric seal means 206 is also provided for sealing.

The remainder of the inner diameter of the outer cylindrical housing contains: a chambered shoulder 208, third surface 210 which contains port 175, chambered shoulder 212, fourth surface 214 which includes port 174, and terminates with external thread means 216.

Referring to FIG. 2E, the power piston 300 is slidably disposed within the outer cylindrical housing 172. The power piston 300 includes on the outer periphery a first surface 302, second surface 304, third surface 306, and fourth surface 308. The fourth surface contains a first recess groove 310 and a second groove 312, along with elastomeric members 314, and 316, respectively.

The fifth surface 318 contains bored through port 320 and terminates with external thread means 322.

Figure 7:
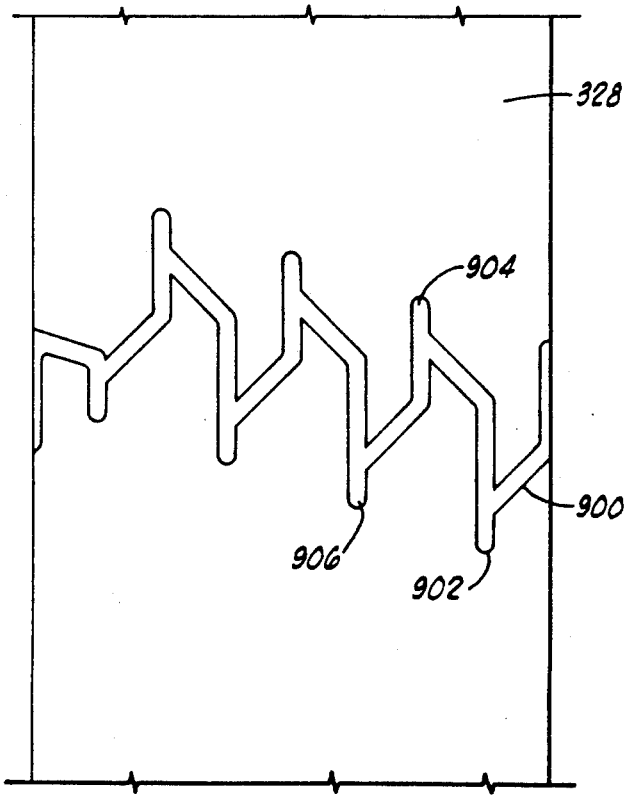
FIG. 7 is an unwrapped profile of the inner component of the ratchet means of the preferred embodiment.

The ratchet means is seen at 324, and generally comprises an outer component 326, an inner component 328, and ball 330. Referring to FIG. 7, the unwrapped profile of the inner component 328 is shown. As those skilled in the art will appreciate, the ball element 330 located in the outer component 326 will travel within this profile as the power piston is urged longitudinally up or down. A more complete detailed description will follow in the operation of the sampler.

The outer component 326 of the ratchet means is threadedly secured to the upper power piston 300 with internal thread means 329, and to the lower power piston 330 with external thread means 332. The lower power piston 330 includes on the outer diameter a first surface 334 which contain wrenching flats 336, and fluid port 338. On the inner diameter of the power piston 330, a first surface 340 contains the fluid port 338, a chamfered surface 342, a second surface 344, a second chamfered surface 346, and third surface 348, concluding with internal thread means 350.

The operating mandrel 352 includes on the outer periphery a first surface 354 which contains a recessed groove 355 and terminates at shoulder 356. The second surface 358 contains a plurality of angled grooves 360 and wrenching flats 362, and terminates at shoulder 364.

An indexing collet 366 is also included. The collet 366 includes on the outer diameter external thread means 368 which threadedly mate with the thread means 120. Extending therefrom is first surface 370, chamfered shoulder 372, second surface 374, second surface 376 and chamfered terminating end 378. Extending radially inward is first surface 380 and flat end 382 which in turn has a chamfered profile 384, that leads to internal surface 386, shoulder 388 and surface 390.

Turning to FIG. 2D, an upper housing member 400 comprises a first surface 402, with wrenching flats 404 contained thereon. Extending radially inward is internal thread means 406 leading to first bore surface 408 which has in turn a second internal thread means 410.

The invention also contains a plurality of means for sampling which generally contains a plurality of atmospheric chamber cases, in series with oil chamber cases followed by a sample chamber. Referring to FIG. 2D, the air chamber case is generally seen at 450. On the outer periphery of the air chamber case 450, the first surface 452 is a cylindrical housing with wrenching flats 454, which in turn has a radially flat shoulder 456 and extending therefrom is a second surface 458. Contained on the second surface 458 is recess 460 which contains elastomeric member 462.

Case 450 has bored therethrough a center passageway 464. Center passageway 464 has a surface 466 of a first diameter and a second surface 468 of increased diameter until cavity 470 is encountered. On the inner diameter of the cavity 470 is internal thread means 472.

The valve means can be seen generally at 474 and comprises a first member 475*a* and second member 475*b*. The first member 475*a* includes: first cylindrical surface 476 which contains recess 478 and elastomeric member 480; shoulder 482; second cylindrical surface 484 that contains recess 486 and elastomeric seal member 488 therein, as well as transverse appendant 490, and terminates at angled end 492. Also, a passageway 494 is bored through the center of the valve 474.

The second member 475*b* of the valve means, includes: a first surface 498 with recess 500 and seal means 502 defined thereon; a chamfered shoulder 504 that has in turn a second surface 506 containing communication aperture 508. Internally thereof, an inner surface 510 forms a cavity so that end 492 can mate, and apertures 508, 490 may be positioned in alignment when valve means 475*b* has been urged axially upward in passageway 468.

Means for impeding the flow of fluid is seen generally at 518. As will be appreciated by those skilled in the art, a restriction (such as an orifice 519) is placed in the passageway. Thus, the fluid in oil chamber 524 is flown to atmospheric chamber case 450, once the apertures 508 and 490 are placed in alignment, but the flow will be impeded because of the means for impeding the flow 518.

A valve means case 512 is securely fastened to the air chamber case 450 with external thread means 514. On the internal diameter, the case contains a first surface and shoulder 516 wherein shoulder 516 and 482 abut.

The impeding means 518 is threadedly secured to end cap 520 which will hold the impeding means in place. The end cap 520 has an internal bore surface 522.

Attached to the end cap 520 is oil chamber case 524. Case 524 includes: a first outer diameter surface 526; a first and second aperture 528 and 530; and a tubing pressure port 532. End cap 520 also includes wrenching flats 534, shoulder 536, external thread means 538 and smooth outer cylindrical surface 540 which contains elastomeric seal means 542. Extending radially inward, case 524 comprises a first smooth bore 544 which terminates at shoulder 546, with second smooth bore 548 extending therefrom, with bore 548 having apertures 528 and 530 disposed therethrough, terminating with internal thread means 550.

Attached to the oil chamber case 524 is the sampler chamber case 600, which in the preferred embodiment will be threadedly secured by internal thread means 602 to threads 538. On the outer periphery of the sampler case 600 is cylindrical surface 604 which contains apertures 606, 607 and recess 608, and terminates at shoulder 610. Extending radially inward, the case includes: internal thread means 612, smooth bore 614, and second internal thread means 616.

Disposed within the sampler chamber case 600 is sampler piston 618, which generally comprises: a first end 620, second end 622, and an outer diameter surface 624 which contains a plurality of elastomeric seal members 626 and 628. The sampler piston 618 is slidably dispose within the case 600 so that as fluid from the workstring enters the case 600, the piston 618 will be urged longitudinally upward.

Disposed within the oil chamber case 524 is metering piston 630. The metering piston 630 includes: a first cylindrical surface 632; a first shoulder 634; a second cylindrical surface 635 containing elastomeric seal means 636; a second shoulder 638; and second cylindrical surface 640. The piston 630 also includes chambered surface 642 which extends to surface 644, which contains seal means 646. It should be noted that seal means 646, 656, 670, and 668 will sealingly engage bore 544.

The piston 630 further comprises: a second chamfered surface 648 which extends to cylindrical surface 650 which has in turn chamfered surface 652; a third surface 654 containing seal means 656; and, shoulder 658. The piston has in turn fifth surface 660 which has aperture 662 therethrough, with surface 660 extending to shoulder 664. Next, sixth cylindrical surface 666 contains elastomeric seal members 668 and 670, respectively.

Extending radially inward of piston 630 is internal bore 672 which terminates at conical end 674. Internal bore 672 intersects aperture 662 so that as piston 630 moves downward, aperture 662 will align with port 532 and bore 672 will provide a passageway for fluid in the tubing string to communicate with piston 618.

Sampler case 600 will have attached intermediate sub 676 which is threadedly attached to the case 600 by means of external thread means 678. Sub 676 also contains internal bore 680. Top end sub 682 is securely attached to the sub 676, and the sampler chamber case is a completely enclosed vessel that can be removed with the sample of fluid intact and without any lost in pressure after the workstring is retrieved from the wellbore.

The apparatus will also contain a cylindrical sub 684, which will abut the top end sub 682. Top mandrel 686 will be threadedly attached to outer mandrel thread means 410 at external thread means 687. The outer cylindrical surface is seen at 688; also, there is included seal means 690 for sealing with bore 408. Internally, bore 692, and 694 provide a central flow area for fluids in the tubing string 6.

Figure 6:
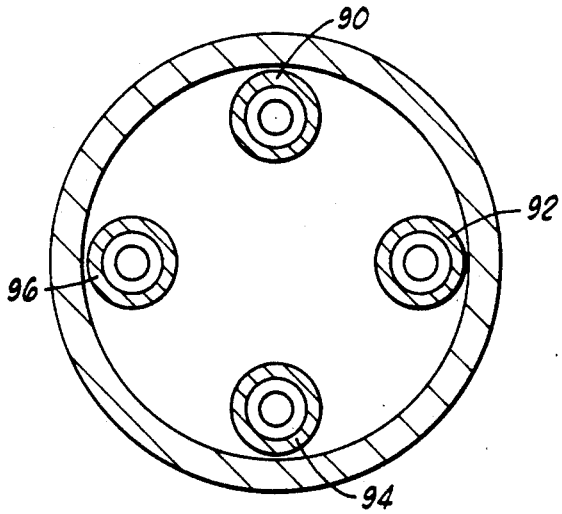
FIG. 6 is a cut-through section of the apparatus taken along line A—A of FIG. 2A, showing the multiple samplers placed about the periphery of the tool.

As best seen in FIG. 6, there are four removable sample chambers 90, 92, 94, and 96 which move their upper ends received in top sub 684. The sample chambers 90,92,94,and 94 are located within the sample chamber housing section 400 at substantially equal elevations, and are circumferentially spaced from each other as shown in FIG. 6 about the longitudinal axis of the sampler apparatus 78.

Figure 3:
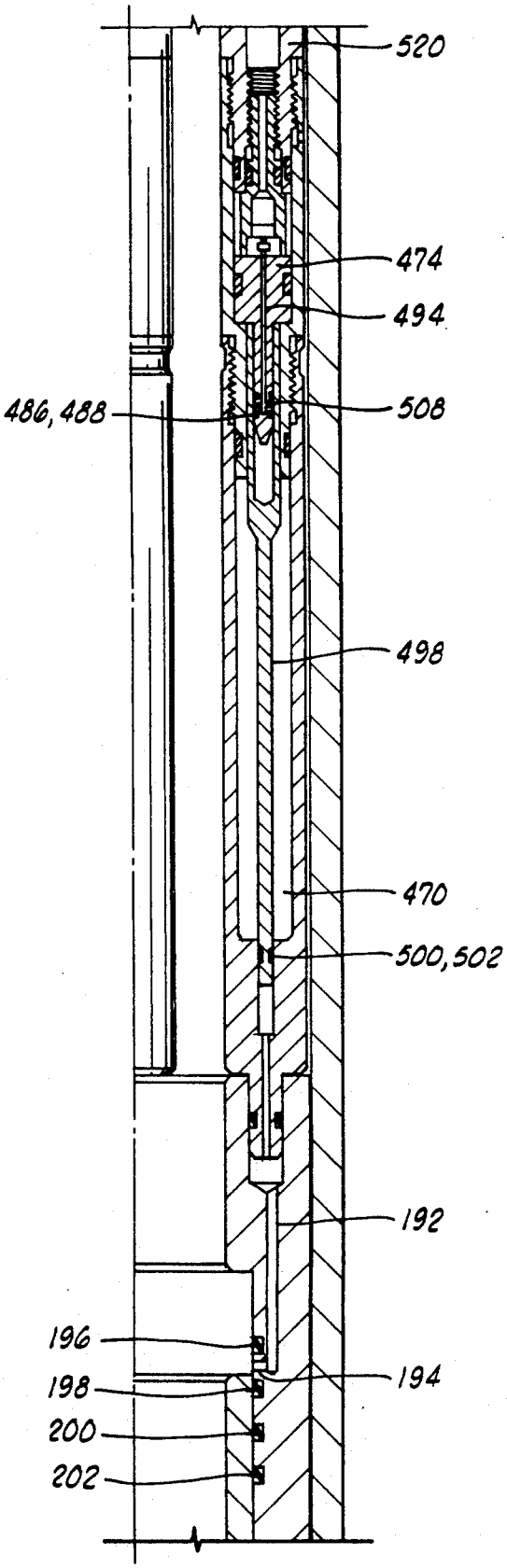
FIG. 3 is a longitudinal sectional view of a portion of the embodiment shown in FIG. 2D, but after a tubing port has been exposed.

FIG. 3 shows a longitudinal sectional view of the embodiment shown in FIG. 2D; however, the operating mandrel 352 has been urged down so that port 194 has been exposed to the hydrostatic pressure of the workstring 6 and port 508 is now communicated with bore 494. Like numbers in FIG. 3 refer to like parts in FIGS. 2A-2K.

SECOND EMBODIMENT

Figure 4A:
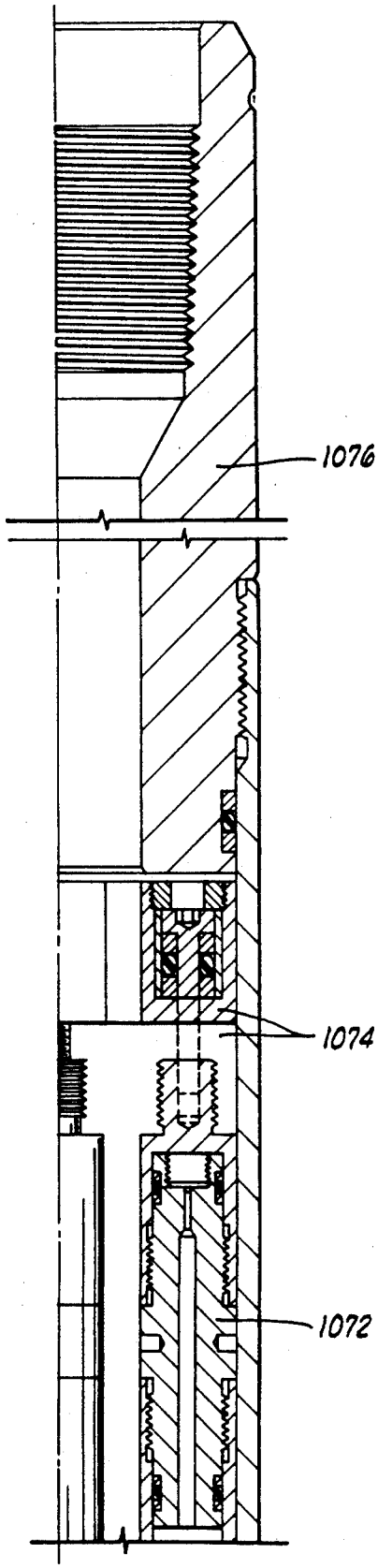
FIGS. 4A–4F form a longitudinal sectional view of a second embodiment to the present invention wherein electronic means is utilized.
Figure 4B:
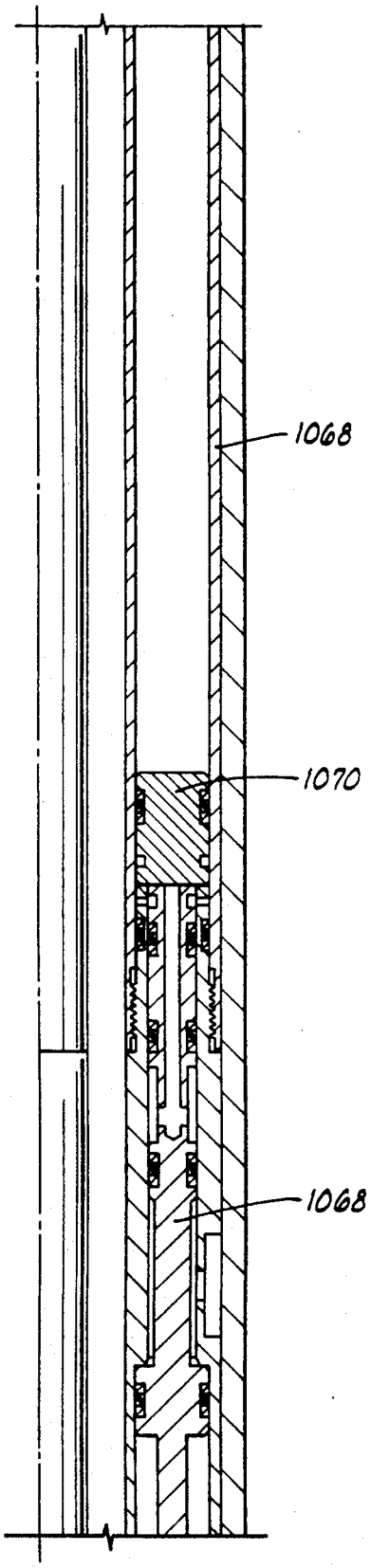
Figure 4C:
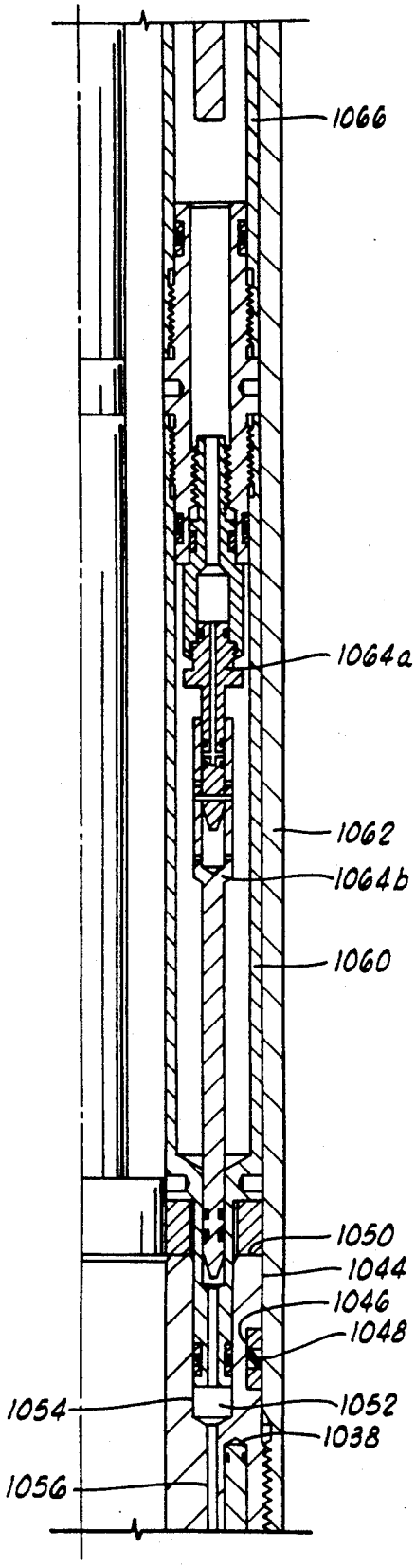
Figure 4D:
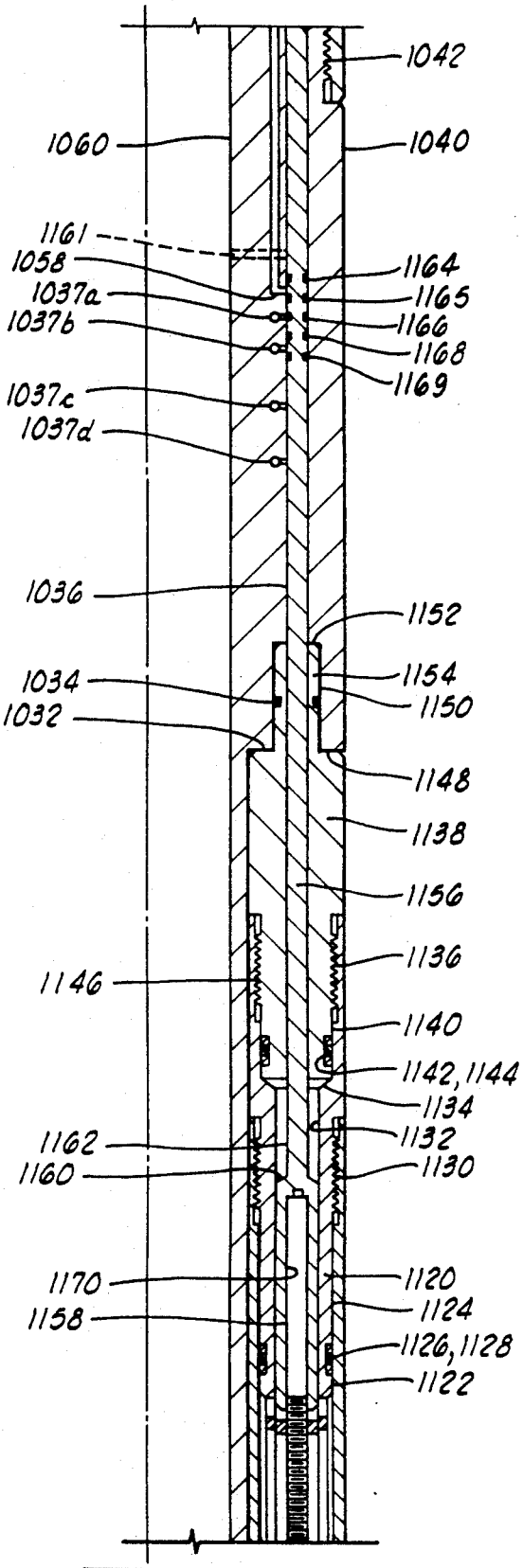
Figure 4E:
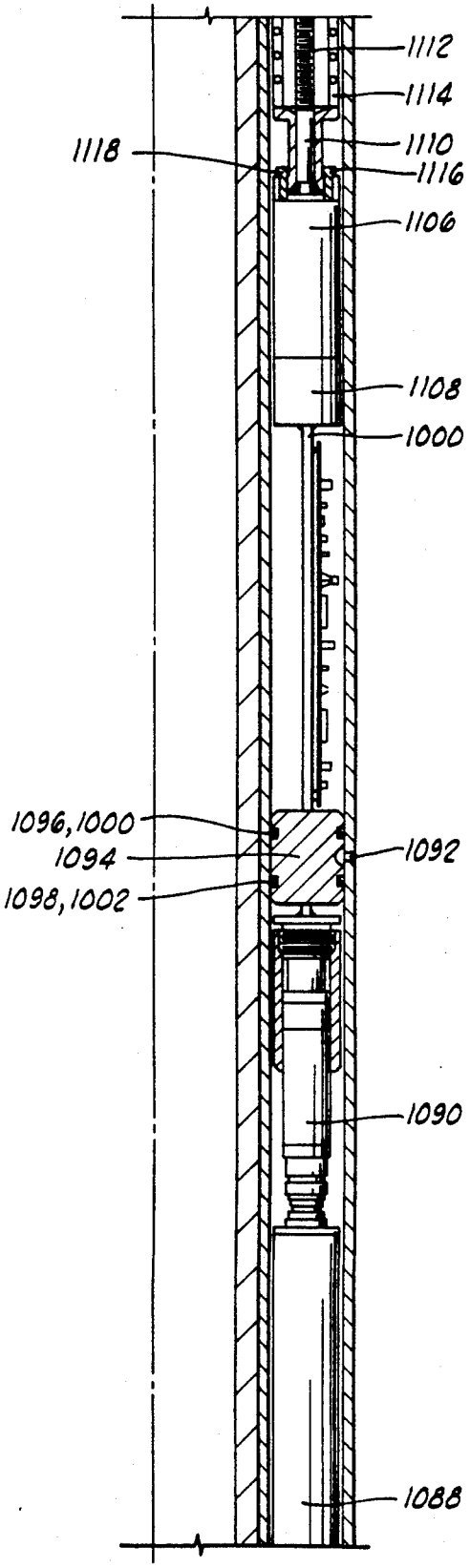
Figure 4F:
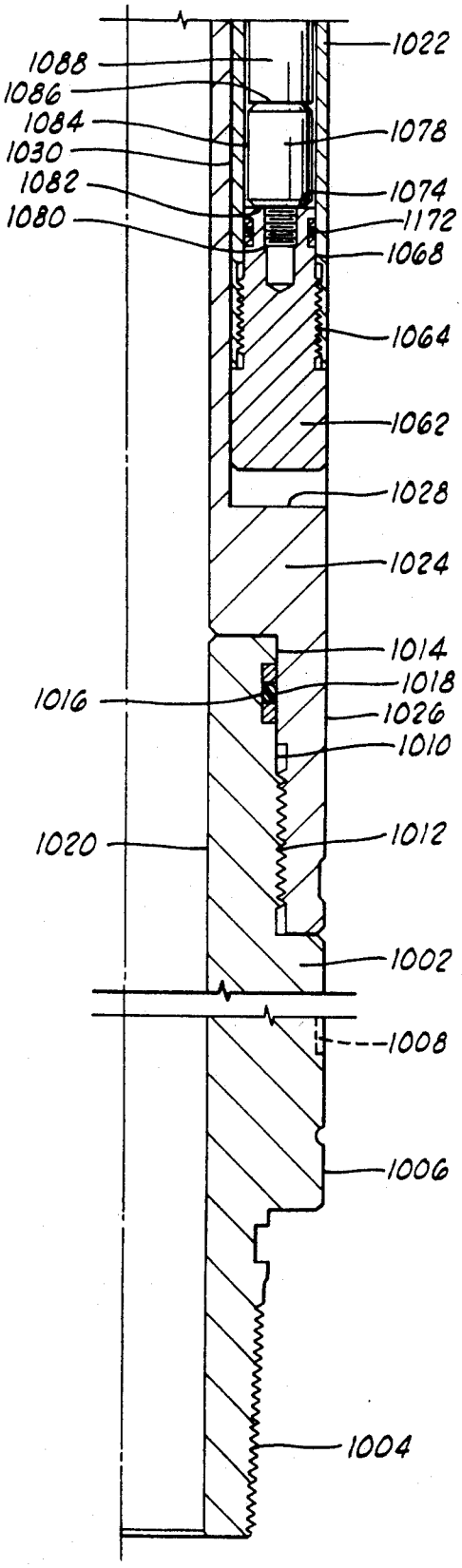

Referring to FIGS. 4A-4F, a second embodiment is shown which utilizes an energizing means 1000, which contains an electronics package and microprocessor, as means for activating the valve means. Referring to FIG. 4F, the tool of this embodiment contains at the first end a bottom sub 1002 containing on the outer diameter external thread means 1004 which has in turn a cylindrical surface 1006 with wrenching flats 1008 disposed thereon. The sub 1002 terminates with a second cylindrical surface 1010 which has defined thereon external thread means 1012, and smooth bore 1014 which has contained thereon a recess 1016 for placement of an elastomeric seal means 1018. Extending radially inward is smooth bore 1020.

Threadedly, releasably engaged with the bottom sub 1002 is the housing section for the valve activating means, seen generally at 1022. The housing section contains a first member 1024, which on the outer diameter has a cylindrical surface 1026 which terminates at radially flat shoulder 1028. Extending therefrom is smooth cylindrical surface 1030 which has in turn a second radially flat shoulder 1032. Shoulder 1032 will contain a first internal bore 1034 and a second bore 1036 which ends at frusto-conical end 1038. Bore 1036 will contain a plurality of ports which are indicated as 1037*a*, 1037*b*, 1037*c* and 1037*d*. Ports a, b, c, and d are in communication with separate passageways (not shown) which lead through the housing member 1024 and are in separate communication with multiple samplers (FIGS. 7; 90, 92, 94 and 96) which are circumferentially placed around the peripheral of the tool.

Shoulder 1028 leads to cylindrical surface 1040, which contains external thread means 1042, sealing bore 1044, recessed groove 1046, and elastomeric seal means 1048 contained therein. Extending radially inward is radially flat shoulder 1050 which has bored therethrough passageway 1052 comprising a first diameter bore 1054 and a second diameter bore 1056 and transverse port 1058 which in turn communicates with bore 1036.

On the inner diameter of the section 1024 is smooth bore 1060. Defined on the smooth bore 1060 will be tubing pressure port 1161, with port 1161 being in communication with bore 1036.

Turning to FIG. 4F, the second member of the housing section 1022, which is a tubular member circumferentially placed about the housing section 1022, has end sub 1062 which has thread means 1064 which has in turn cylindrical surface 1068, which has contained thereon a recess 1070 for placement of an elastomeric seal means 1072. Extending radially inward is shoulder 1074 which has contained thereon threaded bore 1076.

End sub 1062 will have threaded thereto end cap 1078. End cap 1078 will comprise a first generally cylindrical surface 1080 which has defined therefrom thread means which will threadedly mate with the threaded bore 1076. Extending therefrom, the end cap will contain a radially flat shoulder 1082 which extends to cylindrical surface 1084. Surface 1084 terminates at radially flat surface 1086.

Positioned within the cavity of the section 1022 is battery supply means 1088 which will supply electrical power to the electronics package 1000 (also known as the electrical circuit means), pressure transducer, and electric motor. The battery supply means 1088 will have threadedly connected thereto electrical connection means 1090.

Housing section 1022 will have bored therethrough an annulus pressure port 1092; positioned adjacent to the pressure port 1092, but within the inner diameter of section 1022 is pressure sensing means 1094, which in the preferred embodiment is a pressure transducer as shown in FIG. 4E. The pressure sensing means will have a generally cylindrical body containing recessed grooves 1096 and 1098 with elastomeric seal members 1100 and 1102 placed therein so that annulus pressure entering form the pressure port 1092 will be effectively sealed from the battery means and the energizing means.

Also contained within the housing section 1022 is means for energizing the electronic motor, seen generally at 1000. Generally, the energizing means is an electronic package containing means for interpreting the signal created by the pressure sensing means, and upon recognizing a predetermined signal, the electronic package will provide electrical power to and energize the electric motor. In the preferred embodiment, the electronic package will contain a microprocessor which can be pre-programmed to recognize an annular pressure increase, also known as a pressure signal. Further, after the microprocessor has recognized the pressure signal, the pre-programmed logic can then instruct the battery means to energize the electric motor. As will be understood by those skilled in the art, either a microprocessor or hard-wired circuitry can be employed as the energizing means.

As noted earlier, the energizing means will be electrically connected to an electric motor 1106 which will contain a gear reducer 1108 and lead screw 1110 which is of general elongated cylindrical shape and has contained thereon external thread means 1112. Thus, upon activation of the motor, the lead screw will turn or rotate.

Means for supporting the lead screw is also seen at 1114. The supporting means 1114 provides a support structure for the lead screw as well as a guide and is attached to the motor 1106 by securing means such as bolts 1116 and 1118.

Intermediate housing 1120 is of general cylindrical configuration and contains on the outer diameter thereof, a first surface 1122 containing seal bore 1124, recessed groove 1126 for placement of seal means 1128 and external thread means 1130 for threadedly mating the intermediated housing 1120 to the section 1022. Extending radially inward, the intermediate housing 1120 will contain first bore 1132 which extends to chamfered surface 1134, which then extends to internal thread means 1136.

Threadedly, releasably engaged to the intermediate housing 1120 is cylindrical end sub 1138 which has on the outer diameter a first surface 1140 which contains a recess groove 1142 for placement of an elastomeric member 1144, which in turn has external thread means 1146 for mating with the intermediate housing 1120. Radially flat shoulder 1148 terminates at second surface 1150 which has in turn a radially flat terminating end 1152. The terminating end 1152 will have bored therethrough bore 1154 which is in communication with bore 1132 and bore 1036

Mechanical activation means, seen generally at 1156, is of general cylindrical configuration and is placed within bores 1132, 1036 and 1154. The mechanical activation means 1156 will contain on the outer diameter a first surface 1158 which leads to chamfered shoulder 1160, which in turn leads to third surface 1162, with third surface 1162 containing a plurality of elastomeric seal members 1164, 1165, 1166 and 1168 which are place about the periphery of the mechanical activation means 1156.

Extending radially inward of the first surface 1158 is threaded bore 1170 which will threadedly engage the lead screw 1110. Thus, as the lead screw is rotated by the electric motor, the mechanical activation means 1156 will be urged downward as thread bore engages the lead screw. It should be appreciated that as the mechanical activation means is urged down in the bore area the plurality of ports 1037*a, b, c* and d will be selectively exposed.

The remaining structure of the tool is similar in physical makeup with the embodiment previously described. Therefore, only some features will be generally described. Turning to FIGS. 4A–4C, the air chamber case 1060 will be threadedly attached to the outer housing 1062. Disposed therein is the valve means 1064 which contains a first member 1064*a* and a second member 1064*b* separate air chamber case 1060 and the oil chamber case 1066. Disposed in air chamber case is air at atmospheric pressure, while silicon oil will be placed in the oil chamber case 1066.

Slidably disposed in the case 1066 is metering piston 1068. Case 1066 will be threadedly connected to sampler chamber case 1068, with the sampler chamber case containing sampler piston 1070. Case 1068 will be threadedly connected to an end cap 1072, which in turn is mounted with receptacle 1074 not shown, but similar to the structure shown at FIG. 2B, 682, which abuts top sub 1076.

THIRD EMBODIMENT

Figure 5A:
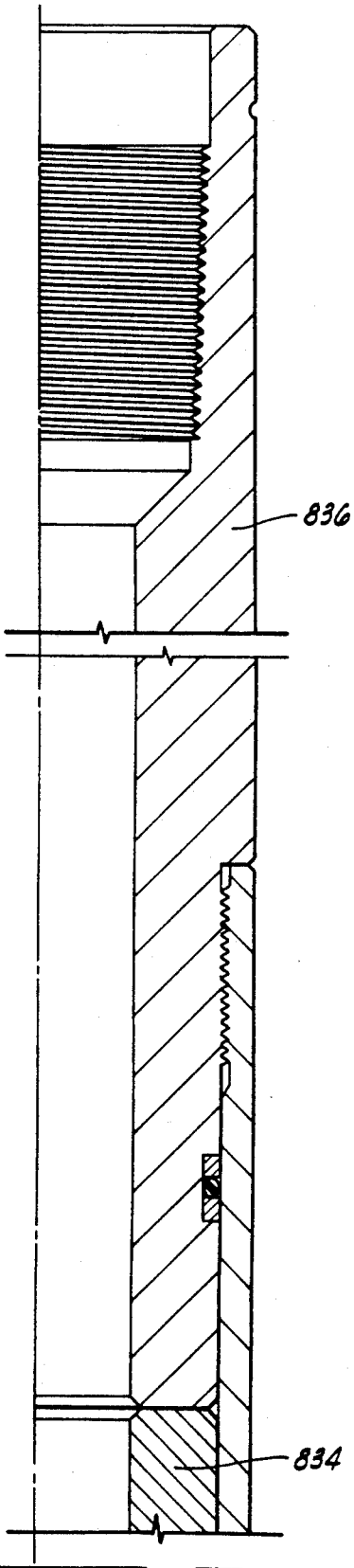
FIGS. 5A–5E form a longitudinal sectional view of a second embodiment of the present invention when a rupture disc is used.
Figure 5B:
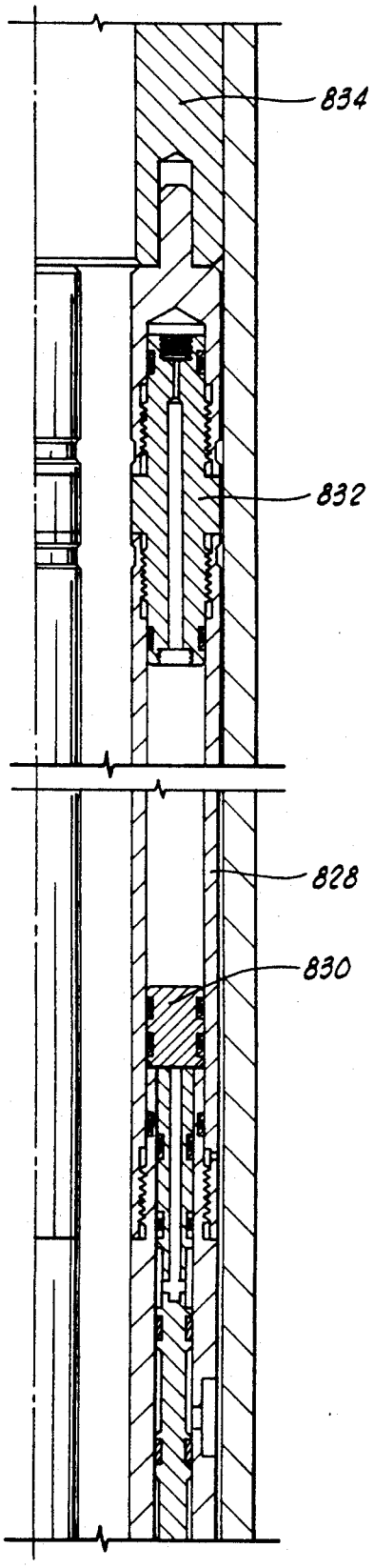
Figure 5C:
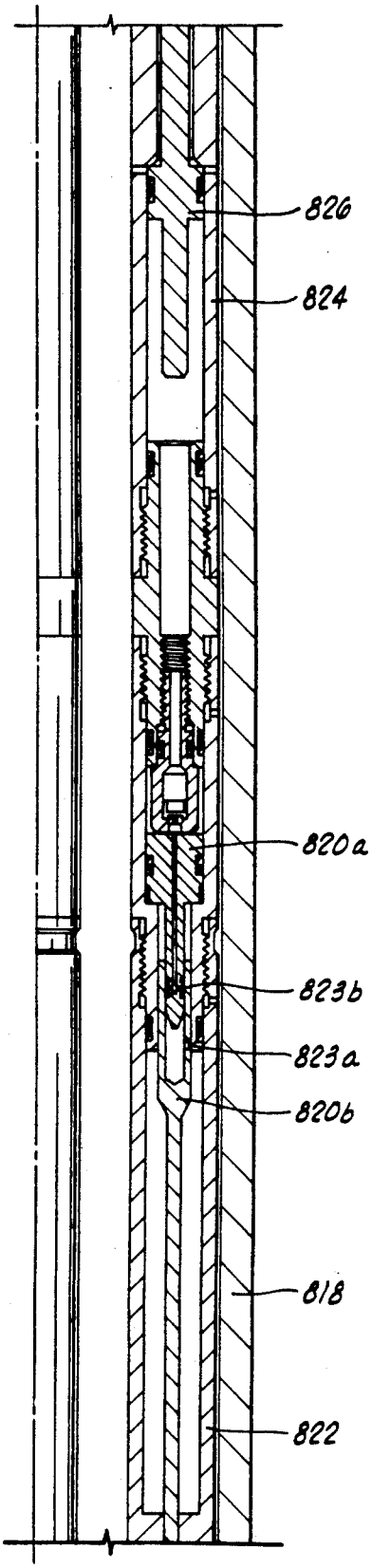
Figure 5D:
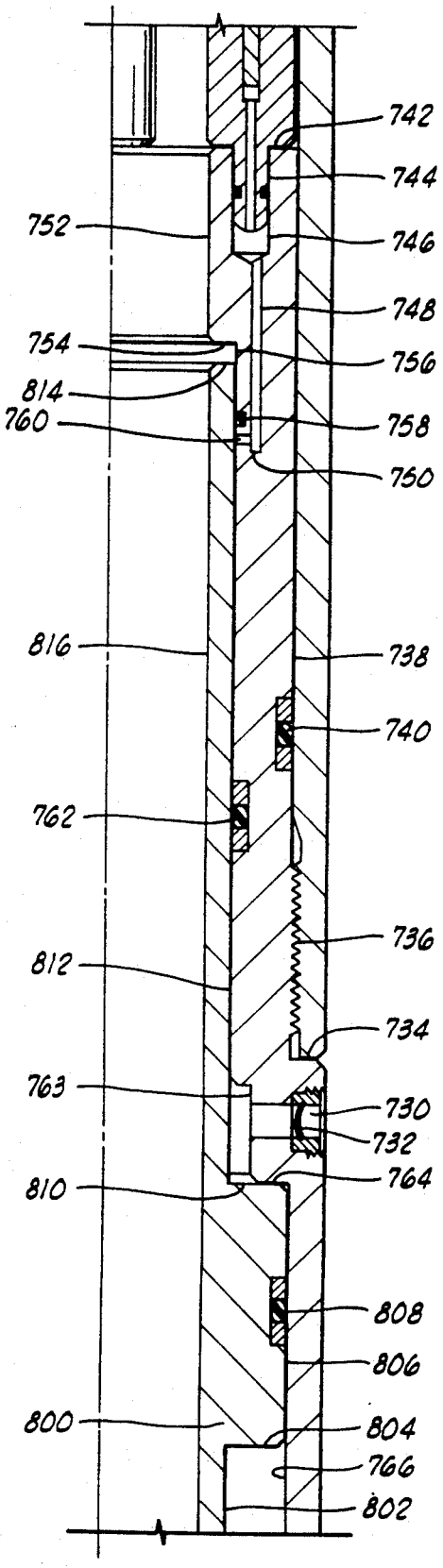
Figure 5E:
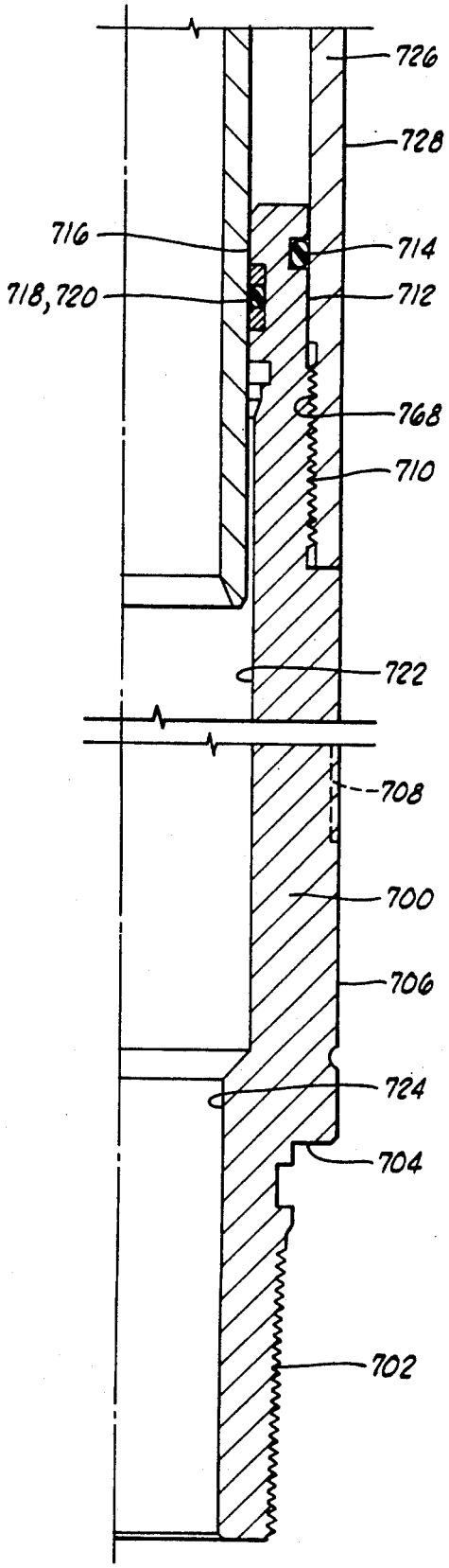

As seen in FIG. 5E, the apparatus has a first mandrel 700 which includes external thread means 702 which terminate at shoulder 704, which has in turn outer cylindrical surface 706, with wrenching flats 708 A second cylindrical surface comprises external thread means 710 and sealing surface 712 with seal means 714. Extending radially inward, first internal surface 716 contains seal means 718, recessed groove 720 bore 722, and 724.

Threadedly attached to the mandrel 700 is atmospheric air chamber case 726. Air chamber case 726 contains on the outer periphery a cylindrical surface 728 containing an aperture 730 wherein a rupture disc means 732 is placed. The air chamber case 726 also contains a shoulder 734 which extends to external thread means 736, having in turn sealing bore 738 which contains seal means 740.

Air chamber case 726 has defined a first end 742, with the first end having an internal bore 744, having a first surface 746, and a second surface 748 which terminates at end 750. Extending radially inward, the case 726 comprises: a first surface 752; a shoulder 754; a second surface 756 with seal means 758 and aperture 760 which communicates with bore 748; second seal means 762; and third surface 763. The third surface 763 has defined thereon the aperture 732, previously described.

Shoulder 764 extends to surface 766 which has in turn internal thread means 768 which will threadedly couple with external thread means 710.

The power mandrel 800 is slidably disposed within the air chamber case 726. On the outer diameter of the power mandrel 800, the mandrel comprises: a first surface 802; a first shoulder 804; a second surface 806 containing seal means 808; a second shoulder 810; a third surface 812; and terminating shoulder 814. Extending radially inward, the mandrel 800 comprises smooth bore 816.

The remaining structure of the tool is similar in physical makeup with the embodiment previously described. Therefore, only some features will be generally described. Turning to FIG. 5C, the air chamber case 726 will be threadedly attached to the outer housing 818. Disposed therein is the valve means 820 which contains a first member 820*a* and a second member 820*b* separate air chamber case 822 and the oil chamber case 824. Disposed in air chamber case is air at atmospheric pressure, while silicon oil will be placed in the oil chamber case 824.

Slidably disposed in the case 824 is metering piston 826. Case 824 will be threadedly connected to sampler chamber 828, with the sampler chamber case containing sampler piston 830. Case 828 will be threadedly connected to an end cap 832, which in turn is mounted with receptacle 834, which abuts top sub 836.

OPERATION

Referring to FIG. 1, initially, the bottom hole assembly will be lowered into the wellbore 4. The bottom hole assembly will contain a tester valve 12, packer means 10, the multiple sampler of the present invention 2, and other various tools as will be appreciated by those skilled in the art.

After the hydrocarbon bearing zone has been perforated, and the packer means set, a flow test (sometimes known as a drill stem test) will be preformed. This will be initiated by opening the tester valve. Thus, as the formation is flown, hydrocarbons will travel vertically upwards in the workstring 6. At some point, it will be necessary to shut-in the producing formation to observe the pressure build-up. When this occurs, hydrocarbons will be trapped in the workstring 6. At this point, a sample can be taken in one of the circumferentially positioned multiple samplers.

Referring to FIGS. 2A–2K, annulus pressure is applied at the surface. This pressure will be transmitted to annulus ports 42, 174, and 176 which will act against piston 43 and power piston 300. Oil chamber case 40 has contained therein silicon oil which will, because of the piston 43, also transmits the hydrostatic pressure. This hydrostatic pressure will in turn be transmitted to the means for impeding the oil 170. Hydrostatic pressure having also been applied through annulus ports 172 and 174, which will act against power piston 300.

As annulus pressure is continued to be applied, the nitrogen piston 16 will act against the nitrogen in nitrogen chamber case 78. The nitrogen is set at a predetermined pressure before the tool is run into the well. Thus, by increasing the hydrostatic pressure, the power piston 300 will in turn act against the nitrogen in case 78. However, the piston 43 is also transmitting pressure; however, due to the impeding means 170, the pressure on upper side of piston 168 will be less, thereby causing a pressure differential to move power piston 300 downward.

As the power piston 300 moves longitudinally downward, the outer component ratchet means 326 will engage the inner, or receptacle, ratchet means 328 located on the operating mandrel 352. Thus, as piston 300 moves downward, the operating mandrel will also move, thereby exposing the tubing port 194 to the hydrostatic pressure contained within the workstring 6, which before that time had been sealed by the operating mandrel 352 and elastomeric seal member 197.

If the increase in the annular hydrostatic pressure is maintained at a constant level, the pressure in the oil case and nitrogen case will equalize. Downward movement of the piston 300 will be limited by top surface 118 of top sub 96. Next, the operator can release the pressure to the annulus. This will cause the pressure in the oil chamber case to decrease, as well as the pressure in the second oil chamber case to decrease, but the pressure in the nitrogen chamber case will still be at an elevated level because of the impeding means.

Thus, the pressure contained in the nitrogen case 78 will act to move pistons 168 and 43; however, because of the impeding means 170, the power piston 300 will first move longitudinally upward.

In the power pistons upward movement, the ratchet means 324 will allow the piston 300 to move, but the operating mandrel 352 will not. As seen in FIG. 7, the ball element 330 will be traveling in the track 900 (also known as the slotted groove), and will not shoulder so that the operating mandrel remains stationary and port 194 will remain exposed.

As regards the operation of the ratchet means 324, and referring to FIG. 7, the ball element 330 will travel in accordance with the movement of the power piston 300 and the outer component 328. Generally, the power piston stroke's (longitudinal length of travel) with respect to the operating mandrel 352 is 2.5". The amount of downward longitudinal travel permitted in the track 900, due to the length of the track, is 2.0". Thus, the ball 330 will travel in the track 900, located on the inner component 328. As the piston 300 moves downward, the ball 300 will shoulder at 902 after the piston 300 has moved longitudinally downward 2.0", thereby causing downward movement of the operating mandrel 352 a half inch. When the piston 300 moves back up, the ball will travel in the track 900, but because of the length of the track in this direction (2.5"), no movement will take place with respect to the operating mandrel 352.

Once the piston has moved the full length of the stroke, which is 2.5", the ball 330 will be at position 904. The sequence is again repeated. Thus, pressure is again applied to the annulus, which will result in the power piston 300 movement longitudinally downward. The ball 330 will travel from position 904, in track 900, until the ball 330 shoulders at 906, which results in an one-half inch downward movement of inner component 328. This sequence is again repeated until all of the inner ports have been exposed to tubing pressure.

The unwrapped view of the inner component 328 shows the configuration of the track 900 wherein downward longitudinal movement of the power piston 300 will result in the mandrel 352 movement down but upper movement of the piston 300 will result in the mandrel 352 remaining static.

Returning to FIG. 2B, the mandrel 352 has disposed thereon grooves or teeth 360 which cooperate with the indexing collet 366. Thus, as the operating mandrel 352 is urged downward, the chamfered profile 384 will engage in one of the grooves 360. This feature ensures that the operating mandrel 352 will not slide longitudinally upward as the piston 300 (and seal means 316) is urged axially upward. The numbers of grooves on the mandrel 352 will correspond to the number of tubing ports 194 included on the inner diameter of the cylindrical housing 172 which corresponds to the number of samplers placed abut the periphery of the tool 2. Chamfered shoulders 346 and 342, of the power piston 300, will engage chambered shoulders 372, 373 of the collet member 386. This provides a minimum resistance for the power piston 300 to overcome as piston 300 travels and insures against movement because of minor pressure fluctuations within the annular wellbore.

After the tubing port 194 has been opened, the hydrostatic pressure in the workstring will be allowed to enter the passageway 192 which will in turn transmits the fluid hydrostatic to passageway 190, and 464. This hydrostatic fluid pressure will work against the lower valve means seen generally at 496 and tend to urge the valve means longitudinally upward so that aperture 508 on the surface 506 will align with aperture 490, which is located on the valve means 474. Once aperture 490 and 508 have been aligned, oil contained in the oil chamber case 524 will be allowed to flow to the atmospheric chamber case 470.

The silicon oil in chamber case 524 had been subjected to the tubing hydrostatic pressure through tubing pressure port 532, and apertures 528, 530 acting against metering piston 600; however, because the valve means had not been aligned, the oil remained in the case and the metering piston did not move. Now that the communication has been established with the air chamber cavity 470, this hydrostatic pressure will tend to urge the metering piston 600 downward, displacing the oil into the air chamber 470.

As metering piston 600 is urged downward, elastomeric seal means 656 will pass tubing port 532. While the piston 600 will continue to be urged downward, the fluid located inside the workstring will now be channeled to aperture 662 which is intersected by axial bore 672 which in turn provides a passageway for the tubing fluid to the sampler case 600.

As the fluid which had been located within the inner diameter of the workstring flows through bore 672, the sampler piston 618 will be unseated, and as the fluid continues to flow, the sampler piston 618 will continue to be urged longitudinally upward, and a fluid sample will be taken in the sample chamber case 600.

Referring to FIG. 6, one can see that multiple samplers can be placed around the periphery of the downhole tool housing. Thus, as the operating mandrel exposes another tubing port, another sampler bottle can be filled as previously described. Since the operating mandrel's movement is controlled by the application of annular hydrostatic pressure, and the application of increased annulus pressure is controlled by the operator, successive movement of the mandrel can be done at different times and different depths in the wellbore.

In the second embodiment of the invention, and referring to FIGS. 4A–4E, the tool is again lowered into the wellbore 4 on the workstring 6 to the desired depth. After the packer has been set, the well can be tested at desired rates. After the flowing period, the operator may wish to collect a sample. Thus, an increase in the annular pressure is applied to the wellbore 4 and subsequently released; the increase and subsequently released annular pressure is known as a pressure signal. The pressure sensing means 1094 will sense the annular pressure and generate an electrical signal in response thereto, with the electrical signal's frequency varying with changes in annular pressure. The energizing means 1104, which will contain a microprocessor in the preferred embodiment, will have been pre-programmed to recognize and interpret the changes in the electrical signal generated by the pressure sensing means.

The microprocessor can be pre-programmed at any combination of annular pressure increases, followed by release of that annular pressure. Thus, depending on the pre-programmed pressure increase sequence (also known as the pressure signal), the exact timing of energizing the electric motor is at the control of the operator.

Returning to the sequential steps of the operation, a pressure increase in the annulus is applied by the operator, and subsequently released. The pressure sensing means 1094 will sense this pressure and generate an electrical signal which will be received by the energizing means and interpreted. The energizing means will then energize the electric motor 1106.

Once the motor 1106 is energized, the lead screw 1110 will rotate accordingly. The thread means 1112 which are engaged with the thread means of the mechanical activation means 1158, will cooperate and the mechanical activation means 1158 will be urged longitudinally downward.

The energizing means has also been programmed to energize the motor for a set amount of time in response to the pressure signal. The amount of time the motor is energized will correspond to the length of travel the mechanical activation means 1158 requires to selectively expose ports 1037*a, b, c* and *d*. In other words, in response to a first pressure signal, the motor will be energized in order to selectively open port a; the motor will then be stopped. In response to a second signal, the motor will again be energized for a sufficient amount of time to expose port b. Next, a third pressure signal will be initiated and the energizing means will energize the motor and port c will be exposed. This sequence can be repeated for as many ports which are contained in the housing member 1024.

As ports 1037*a, b, c,* and *d* are exposed, wellbore fluid, which had been acting on port 1161 will be allowed to flow to the ports 1037. The well fluid path will be to enter at port 1161, transmitted through annulus area formed by the mechanical activation means 1158 and bore 1036. As the seal means 1164 selectively expose ports 1037, the fluid will travel to each of the plurality of passageways which are in communication with the valve means located about the periphery of the housing.

The valve means will then be activated as previously described in the operation of the preferred embodiment. Thus, a plurality of samplers, as seen in FIG. 6, can be place about the periphery of the tool, as previously described. Each sampler can be individually activated, at the desired depth and time, as determined by the operator.

In the third embodiment of the invention, and referring to FIGS. 5A-5E, the tool is again lowered into the wellbore 4 on a workstring 6 and the packer set, as previously described. In order to obtain a sample of fluid located in the workstring, annulus pressure is applied. This pressure will act against the rupture disc 732 via aperture 730. The rupture disc is selected according to a predetermined rupture rating. In other words, the rupture disc is preselected to burst at a certain pressure, and once that pressure has been applied by the operator, the disc 732 will rupture.

Hence, once a sufficient amount of annulus pressure has been applied, the disc 732 will burst, allowing the hydrostatic pressure to act against shoulder 764 of the power mandrel 800. The chamber case 726 contains air at atmospheric pressure and the power mandrel will be urged downward, thereby exposing aperture 760 to the hydrostatic workstring pressure. The pressure will be transmitted via passageway 748 to the lower valve means 821. The lower valve means will be urged axially upward in passageway, so that aperture 823*a* and 823*b* will be aligned and the oil in chamber 824 will be allowed to flow into the air chamber case 822. A fluid sample can be taken identically to that described in the first embodiment at this point.

Therefore, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A downhole sampling apparatus positioned within a wellbore, on a tubing string containing an internal diameter, and the tubing string and wellbore forming an annulus, the apparatus comprising:

a cylindrical housing having a portion defining a first annulus port;

a first power piston slidably disposed within said cylindrical housing movable between an initial position and a second position, said first power piston being responsive to an increase in the annulus pressure as communicated through said first annulus port to move said power piston from the initial position to the second position;

a concentric housing disposed within said cylindrical housing and containing a plurality of tubing ports;

means for biasing said first power piston so that as annulus pressure is released, said first power piston returns to the initial position;

a first and second case located within said cylindrical housing, said first chamber case being exposed to tubing hydrostatic pressure and wherein said first case has contained therein oil and said second chamber case has contained air at atmospheric pressure;

valve means, located between said atmospheric chamber case and said oil chamber case, for controlling flow of oil to the air chamber, said valve means having an open position and a closed position;

valve activating means, operably associated with said first power piston, for supplying tubing hydrostatic pressure to said valve means so that said valve means is placed in the opened position; and means for sampling a portion of fluid contained within said tubing, string said sampling means being responsive to said vale means.

2. The apparatus of claim 1, wherein said biasing means comprises:

a first cylindrical member having a first and second piston disposed therein, forming a first, second and third chamber within said first cylindrical member, wherein said first chamber is communicated with said annulus, said second chamber is filled with pressurized nitrogen and said third chamber is filled with oil;

a second cylindrical member attached to said first cylindrical member having a piston disposed therein, said piston forming a first and second chamber, said first chamber containing oil and said second chamber containing an annulus port and being communicated with the annulus so that said piston is responsive to increases and decreases in annulus pressure; and impedance means, located between said first cylindrical member and said second cylindrical member, for impeding the flow of the oil between said first chamber and said second chamber of said second cylindrical housing.

3. The apparatus of claim 1, wherein said valve means comprises:

a first valve stem containing a passageway and transverse port;

a cylindrical body assembly attached to a said first valve stem containing a passageway, said passageway containing impedance means for impeding flow is said passageway;

a second stem having cavity with a transverse port so that said first stem and said cavity on said second stem are operably associated; and wherein, said second stem is slidably disposed within said tubing passageway so that said stem is responsive to hydrostatic changes within said passageway.

4. The apparatus of claim 3, wherein said valve actuating means comprises:

an operating mandrel slidably disposed within said concentric housing and sealingly isolating said plurality of tubing ports from the hydrostatic pressure of the internal diameter of the tubing string;

ratchet means for axially urging said operating mandrel downward in response to movement of said power piston so that as said operating mandrel is urged downward, one of the plurality of said tubing ports are exposed to tubing hydrostatic pressure; and collet means for retaining said operating mandrel and preventing axial upward movement of said operating mandrel.

5. The apparatus of claim 4, wherein said sampling means comprises:

a metering piston valve slidably disposed within said oil chamber, said metering piston containing a portion defining a tubing hydrostatic passageway;

a sampling case disposed within said cylindrical housing;

elastomeric means, located about said metering piston valve, for sealing tubing hydrostatic pressure from said tubing hydrostatic passageway; and a sampler piston contained within said sampling case, and located adjacent to said metering piston valve.

6. The apparatus of claim 5, further comprising:

ratchet means for selectively urging said operating mandrel longitudinally downward in response to an increase in annulus pressure; and means for retaining said operating mandrel from longitudinally upward movement.

7. The apparatus of claim 6, wherein said selective urging means comprises:

a ratchet outer component located on said first power piston;

a ratchet inner component located on said operating mandrel and mounted adjacent to said ratchet outer component, said ratchet inner component having defined thereon a ratchet profile; and a ball element fitted between said ratchet inner and outer component, said ball element being located within said profile.

8. The apparatus of claim 7, wherein said operating mandrel retaining means comprises:

an indexing collet threadedly attached to said cylindrical housing, said indexing collet containing a shoulder; and wherein said operating mandrel contains a plurality of grooves so that said shoulder on said indexing collet cooperate with said grooves on said operating mandrel.

9. The apparatus of claim 7, wherein said sampling means are arranged about the periphery of said cylindrical housing.

10. A valve apparatus for use in a downhole tool on a workstring in a wellbore, the workstring having an internal diameter with the workstring and wellbore forming an annulus, said valve apparatus comprising:

a cylindrical housing assembly having a portion defining a tubing port and passageway being in communication with the internal diameter of the tool;

means for selectively exposing said tubing port to a hydrostatic pressure in the internal diameter of the downhole tool;

a valve case being contained within said cylindrical housing assembly;

a first valve member located within said valve case, said first valve member forming a first valve case chamber and a second valve case chamber, said first valve member comprising;

an elongated cylindrical stem including;

a transverse port and radial bore therethrough;

a valve body containing a radial bore in communication with said radial bore of said elongated cylindrical stem; and impedance means for impending the flow of fluid from said first valve case chamber to said second valve case chamber; and a second valve member containing a first end and a second end and a second end slidably disposed within said passageway and responsive to increases and decreases in hydrostatic pressure within the internal diameter of the downhole tool.

11. The valve apparatus of claim 10, wherein said first valve case chamber is filled with silicon oil and second valve case chamber is filled with air at atmospheric pressure.

12. The valve apparatus of claim 10, wherein said second valve member comprises:

an elastomeric seal means disposed about the first end;

the second end having a cylindrical member, said cylindrical member having a transverse port so that upon movement of said first valve member, the transverse port of the second valve member and the transverse port of the first valve member will be substantially aligned; and wherein, as pressure in the internal diameter of the tool increases, said second valve member moves longitudinally upward to that said transverse ports in said first and second valve members are aligned, allowing communication between said first valve case chamber and said second valve case chamber.

13. A downhole sampling apparatus contained on a tubing string containing an internal diameter in a wellbore, with the tubing string and wellbore forming an annulus, the apparatus comprising:

a cylindrical housing means for housing the apparatus, said cylindrical housing means having a portion defining a first annulus port and a plurality of tubing ports;

a first power piston slidably disposed within said cylindrical housing means;

means for axially urging said power piston longitudinally downward;

an atmospheric chamber case and oil chamber case located within said cylindrical housing means, said atmospheric chamber containing air and said oil chamber case containing oil, said oil chamber case being exposed to tubing hydrostatic pressure;

valve means, located between said atmospheric chamber case and said oil chamber case, for controlling flow of the oil to the air chamber;

valve actuating means for supplying tubing hydrostatic pressure to said valve means so that said valve means can be opened, means for sampling a portion of fluid contained within the tubing string, said sampling means being responsive to said valve means.

14. The sampling apparatus of claim 13, wherein said axial urging means comprises:

a rupture disc located in said first annulus port blocking annular hydrostatic pressure, said rupture disc being selected to burst at a pre-determined pressure; and an atmospheric chamber case having disposed therein a power piston.

15. The sampling apparatus of claim 14, wherein said valve means comprises:

a first stem containing a passageway and transverse port;

a cylindrical body assembly, attached to said first stem, containing a passageway;

impedance means, located in the first stem passageway, for impeding flow in said passageway;

a second stem having a cavity formed on one end and a traverse port defined through said stem so that said first stem and second stem are operably associated; and wherein, said second stem is slidably disposed within said cylindrical body assembly passageway so that said second stem is responsive to hydrostatic pressure changes within said passageway.

16. The sampling apparatus of claim 15, wherein said valve actuating means comprises:

an operating mandrel slidably disposed within said cylindrical housing means and sealingly isolating said plurality of tubing ports;

a portion of said cylindrical housing means having a passageway in communication with said first tubing port; and wherein, as said operating mandrel moves longitudinally downward, said tubing port is exposed to tubing hydrostatic pressure.

17. An apparatus for sampling fluids located in a workstring the workstring being positioned within a wellbore, forming an annulus, comprising:

cylindrical housing assembly means for housing the apparatus containing a plurality of tubing ports and a passageway;

means for selectively exposing said tubing ports;

an atmospheric chamber case and oil chamber case located within said cylindrical housing, said oil chamber case being in fluid communication with said tubing ports, said atmospheric chamber case containing air at atmospheric pressure and said oil chamber case containing silicon oil;

valve means, located between said atmospheric chamber and said oil chamber case and operable between an open position and a closed position, for controlling flow of the oil to said air chamber case;

valve actuating means, operably associated with said tubing hydrostatic ports, for supplying working pressure to said valve means so that said valve means can be opened; and means for sampling a portion of fluid contained within said workstring, said sampling means being responsive to said valve means.

18. The apparatus of claim 17, wherein said means for selectively exposing said tubing ports comprises:

a first power piston slidably disposed within said cylindrical housing assembly means at an initial position, said first power piston being responsive to changes in the annulus pressure as communicated through said first annulus port so that said power piston locates to a second position; and means for biasing said first power piston so that as annulus pressure is released, said first power piston returns to the initial position.

19. The apparatus of claim 18, wherein said valve means comprises:

a first stem containing a passageway and transverse port;

a cylindrical body assembly containing a passageway and impedance means for impeding flow in said passageway;

a second stem having a cavity formed at one end with a transverse port defined therethrough so that said first stem and second stem are operably associated; and wherein, said second stem is slidably disposed within said housing assembly means passageway so that said stem is responsive to hydrostatic changes with in said passageway.

20. The apparatus of claim 19, wherein said valve actuating means comprises:

an operating mandrel slidably disposed within said cylindrical housing assembly means and sealingly isolating said first tubing port, operably associated with said power piston;

ratchet means for axially urging said operating mandrel downward in response to movement of said power piston so that as said operating mandrel is urged down, said tubing port is exposed to tubing hydrostatic pressure; and collet means for retaining said operating mandrel and preventing axial upward movement of said operating mandrel.

21. The apparatus of claim 20, wherein said ratchet means comprises:

a ratchet outer component located on said first power piston;

a ratchet inner component located on said operating mandrel and mounted adjacent to said ratchet outer component, said ratchet inner component having defined thereon a ratchet profile; and a ball element fitted between said ratchet inner component and said outer component, said ball element being located within said profile so that as said ball element cooperates with said power piston, said ball element will travel within the profile.

22. A downhole sampling apparatus positioned within a wellbore, on a workstring, the workstring containing an internal diameter, and the workstring and wellbore forming an annulus, the apparatus comprising:

cylindrical housing means having a portion defining a first annulus port, a first tubing port and a tubing passageway;

a first and second case located within said cylindrical housing means, said first chamber case being exposed to internal diameter workstring hydrostatic pressure housing and wherein said first case has contained therein oil and said second chamber case has contained air at atmospheric pressure;

valve means, located between said atmospheric chamber case and said oil chamber case, for controlling flow of the oil to the air chamber, said valve means having an open position and a close position;

valve activating means, operably associated with said first power piston, for supplying tubing hydrostatic to said valve means so that said valve means is placed in the opened position; and means for sampling a portion of fluid contained within said tubing sorting, said sampling means being responsive to said valve means.

23. The apparatus of claim 22, wherein said cylindrical housing means contains a second annulus port, and wherein said valve activating means comprises:

annular pressure sensing means for sensing the annulus pressure;

an electric motor mounted within the cylindrical housing means, said electric motor containing a shaft mounted thereon, the shaft containing external thread means;

means for energizing said electric motor in response to a pressure signal sensored by said sensing means;

mechanical activation means, operably associated with the shaft of said motor, for exposing the tubing port to hydrostatic pressure; and battery supply means for supplying electrical power to said electric motor, energizing means, and sensing means.

24. The apparatus of claim 23 wherein said annular pressure sensing means is a pressure transducer.

25. The apparatus of claim 24 wherein said energizing means is a microprocessor.

26. The apparatus of claim 25 wherein said mechanical activation means is a shaft with internal thread means defined thereon so that as the shaft mounted on said electric motor is rotated, the shaft reciprocally rotates longitudinally downward thereby exposing the tubing port.

* * * * *